US007213985B1

(12) United States Patent
Chen

(10) Patent No.: US 7,213,985 B1
(45) Date of Patent: May 8, 2007

(54) METHOD FOR IMAGE REPRODUCTION AND RECORDING WITH THE METHODS FOR POSITIONING, PROCESSING AND CONTROLLING

(75) Inventor: Laurence Lujun Chen, West Hills, CA (US)

(73) Assignee: Laurence L Chen, West Hills, CA (US)

( * ) Notice: Subject to any disclaimer, the term of this patent is extended or adjusted under 35 U.S.C. 154(b) by 416 days.

(21) Appl. No.: 10/638,589

(22) Filed: Aug. 9, 2003

Related U.S. Application Data

(60) Provisional application No. 60/402,233, filed on Aug. 12, 2002.

(51) Int. Cl.
*B41J 3/28* (2006.01)

(52) U.S. Cl. ..... 400/29; 400/30; 400/88

(58) Field of Classification Search ..... 400/29, 400/30, 88

See application file for complete search history.

(56) References Cited

U.S. PATENT DOCUMENTS 5,446,559 A * 8/1995 Birk ..... 358/473
5,927,872 A * 7/1999 Yamada ..... 400/88
6,738,044 B2 * 5/2004 Holzrichter et al. ..... 345/158
6,773,177 B2 * 8/2004 Denoue et al. ..... 400/88
7,044,665 B2 * 5/2006 Cannell et al. ..... 400/323

* cited by examiner

*Primary Examiner*—Minh Chau

(57) ABSTRACT

New method for Image reproduction and recording is based on mechanical-guiding-apparatus-free operating methods, with flexible operations (hand, robot, vehicle), with the means for positioning, processing and controlling, and having exclusive plurality of uses. The system for image reproduction and recording based on this method includes these common apparatuses: head carrier, sprayer/reader or sprayer/reader array, and computer. Additional apparatuses used in wave-based positioning methods or relative-motion-based positioning methods, include operation-unit (OU) and communication-units (CU's), or operation-module (OM) and motion-detectors (MD), or respectively. The MD and OM provide the information of positioning for computer to determines the relative position and direction of the head array on head carrier. The CU's radiate and receive signal needed for determining distance information. The OU processes and converts the received signal into distance-related data and pass to computer. The computer determines the coordinates of each head in the head array from these data, and sends it back to OU or OM. Then the OU or OM sends the color data and spraying commands to head array, and provides power for head, or sends reading commands to head array for reading color data.

26 Claims, 12 Drawing Sheets

43

45

46

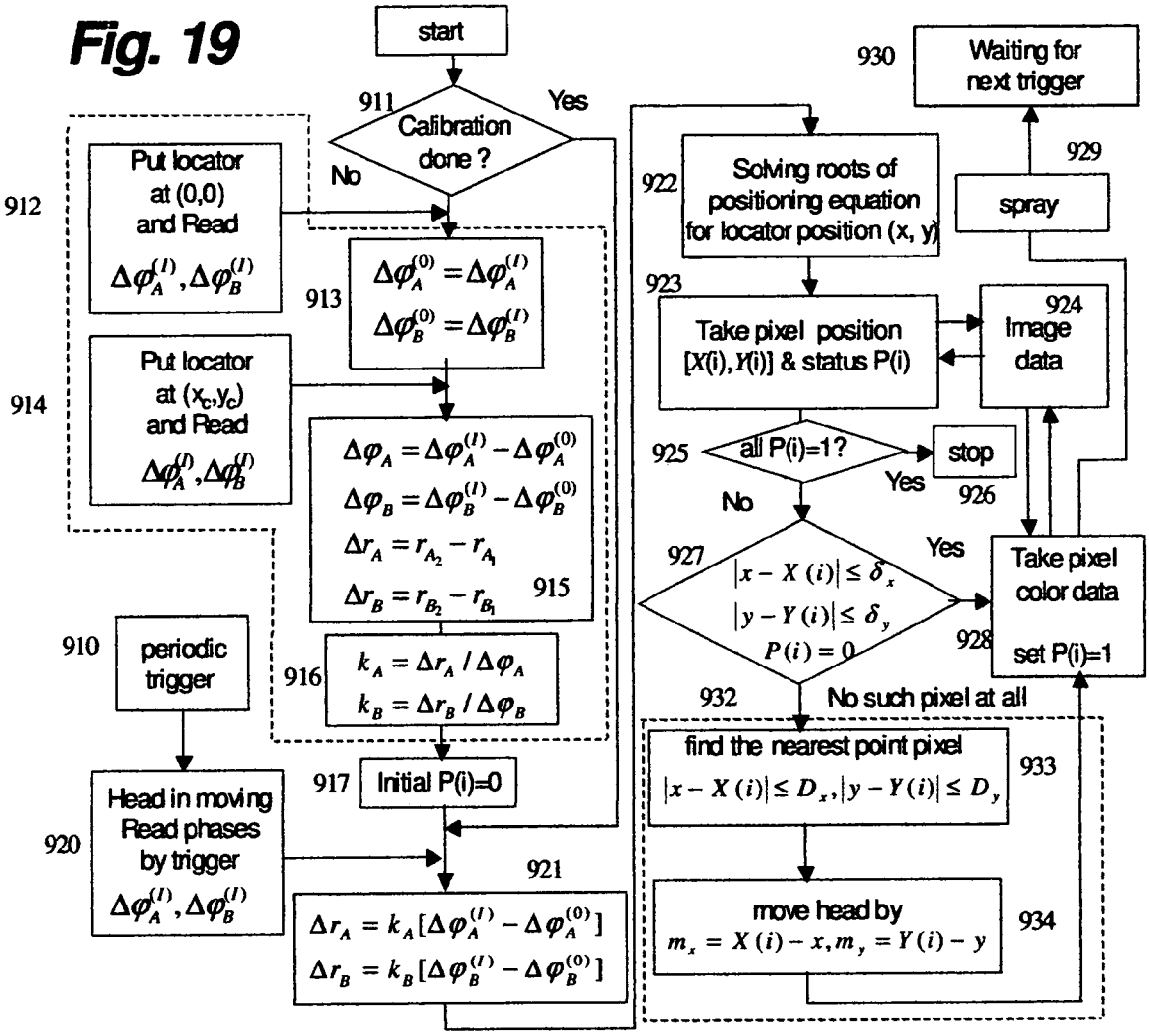
Fig. 19
start
911
Calibration done ?
Yes
No
912
Put locator at (0,0) and Read
$\Delta\varphi_A^{(I)}, \Delta\varphi_B^{(I)}$
913
$\Delta\varphi_A^{(0)} = \Delta\varphi_A^{(I)}$
$\Delta\varphi_B^{(0)} = \Delta\varphi_B^{(I)}$
914
Put locator at $(x_c, y_c)$ and Read
$\Delta\varphi_A^{(I)}, \Delta\varphi_B^{(I)}$
$\Delta\varphi_A = \Delta\varphi_A^{(I)} - \Delta\varphi_A^{(0)}$
$\Delta\varphi_B = \Delta\varphi_B^{(I)} - \Delta\varphi_B^{(0)}$
$\Delta r_A = r_{A_2} - r_{A_1}$
$\Delta r_B = r_{B_2} - r_{B_1}$
915
910
periodic trigger
916
$k_A = \Delta r_A / \Delta\varphi_A$
$k_B = \Delta r_B / \Delta\varphi_B$
917
Initial P(i)=0
920
Head in moving Read phases by trigger
$\Delta\varphi_A^{(I)}, \Delta\varphi_B^{(I)}$
921
$\Delta r_A = k_A[\Delta\varphi_A^{(I)} - \Delta\varphi_A^{(0)}]$
$\Delta r_B = k_B[\Delta\varphi_B^{(I)} - \Delta\varphi_B^{(0)}]$
922
Solving roots of positioning equation for locator position (x, y)
923
Take pixel position [X(i),Y(i)] & status P(i)
924
Image data
925
all P(i)=1?
Yes
stop
926
No
927
$|x - X(i)| \le \delta_x$
$|y - Y(i)| \le \delta_y$
$P(i) = 0$
Yes
Take pixel color data
set P(i)=1
928
932
No such pixel at all
find the nearest point pixel
$|x - X(i)| \le D_x, |y - Y(i)| \le D_y$
933
move head by
$m_x = X(i) - x, m_y = Y(i) - y$
934
930
Waiting for next trigger
929
spray

METHOD FOR IMAGE REPRODUCTION AND RECORDING WITH THE METHODS FOR POSITIONING, PROCESSING AND CONTROLLING

CROSS-REFERENCE TO RELATED APPLICATION

PCT/US03/25111, filed on 11 Aug. 2003 and from the provisional U.S. Patent Application No. 60/402,233, filed on 12 Aug. 2002 entitled "System and its apparatuses for image reproduction and recording with the methods for positioning, processing and controlling".

FIELD OF THE INVENTION

The present invention relates to a method to reproduce and to record image with a flexible operation (by hand, robot or vehicle) of head carrier without mechanical-guide-apparatus, and the corresponding apparatuses and methods for positioning, processing, and controlling. The motivation is to build a flexible operation (i.e. without a track guide) for image reproduction and recording system, instead of present conventional image reproduction and recording systems in plurality of uses. Due to the flexibility of this invention in operation, the size of image that will be reproduced or will be recorded can be as large as the wall of a building, or golf course, or cliff of a mountain, or can be as small as any size as long as it still makes sense. Therefore, it can be used for plurality of applications, such as images and patterns on building wall or cliff, golf courses, basketball courts, football/soccer fields, billboards, posters, portraits and paintings, industry design blue prints, industry decorations, decoration arts (such as depositing a pattern on china arts), home painting and wall decorations, archaeological image/pattern taking and museum image/pattern backup, sculptures, etc. It can be used for applications either on any flat surface, or on any curved surface.

BACKGROUND OF THE INVENTION

The conventional method for image reproduction and image recording s, such as the methods used in printing devices and scanning devices sold in the electronics store and those described in U.S. Pat. Nos. 5,968,271, 5,273,059, 5,203,923, 4,839,666, 5,707,689, 6,369,906, 5,642,948, 5,272,543[1-8] etc are based on the track-guided positioning systems. The spraying head or reading (recording) head is driven by electric motors and is limited on a track through the precise mechanical-apparatus for positioning. Therefore, they have limitation in size and service objectives, and they have no flexibility for plurality of applications, such as image on billboards, on the walls, with huge size or on a curved surface, etc. Also the conventional method is mechanical-apparatus based and is complex and costly. Therefore the motivation of this invention is to build the flexible hand-operated, or robot-operated or vehicle carried systems for image reproduction and recording. Due to the flexibility of operation, the image that will be reproduced or will be recorded can be arbitrary large, and can be used for either any flat surface, or any curved surface.

SUMMARY OF THE INVENTION

The key spirits of present invention is the new method for image reproduction and recording with a flexible hand-operated or robot-operated or vehicle carried head carrier, and the corresponding apparatuses and methods for positioning, processing, and controlling. The systems based on this method are flexible, easy and very convenient to use for a plurality of users from industries, offices and home, home decorations, entertainment and arts, etc., instead of the complex and costly precise mechanical-apparatus based systems in present conventional method for image reproduction.

A further object of the present invention is to provide constitutions and apparatuses for head positioning, data processing, and head controlling.

To achieve the above objects, the first aspect of the invention provides the method for image reproduction on any surface based on image data stored in computer, by arbitrarily moving the flexible-operation (hand, robot, vehicle) apparatus, i.e. head carrier, on the surface. The systems based on this method could have variation of versions, depending on the methods used for positioning. The positioning methods for image reproduction are classified into two catalogs: the wave-based method and relative-motion-based method. The systems using both methods comprise these apparatuses: head carrier, sprayer/sprayer array, operation unit (OU), and a computer for processing and control. Besides these apparatuses, the wave-based method also includes the communication units (CU) and the relative-motion-based method includes two relative motion detectors (MD).

In the relative-motion-based method, operation unit (OU) is also called operation module (OM) for convenient in the description below, so as to avoid the confusion with the OU used in wave-based method. The system operation procedures include: OM executes the commands from computer to read the motion information of head from MD, and organizes this information as time-sequences. Then OM sends these time-sequences to computer by multi paths (in parallel). Computer processes the information for locator positioning and determining the coordinates of each head in the head array. The OM executes the commander from computer to control the action (spraying or reading) of the head in head array. For recording system, the OM takes the image information at each image pixel on sensor array, and organizes this information as time-sequences and sends them to computer. Also, as the alternates, any computer-mouse techniques can be employed as MD.

In the wave-based method, the system operation procedures include: operation unit (OU) produces and sends the signal current to the transmitting CU. The transmitting CU radiates and the receiving CU receives the radio frequency (RF), electromagnetic wave, light or ultrasonic signals that carry the information of the phase differences or the time differences. The information is sent back to the OU from the receiving CU. The OU processes and converts the information into the data of phase differences or time differences, and sends the data to computer. Another alternate uses Doppler effect to detect the velocity of the receiving CU, and computer calculates the moving distance by integrating the velocity.

Computer processes these data and inverses the position coordinates of the sprayer/sprayer array by using the claimed positioning methods in this invention. According to the position coordinates, computer searches for the nearest pixel to this position in the image data file stored in disk of the computer, takes the color data of this pixel, and sends the data to OU or OM. Then OU or OM sends commands and power to the head to execute the jobs (spray or record). Computer then records the history of the image reproducing or recording process. Any pixel, of which the corresponding image has been generated (sprayed or read) on the image surface, will be marked by the computer, and displayed on the computer screen, and will not be generated again if the head moves back to the same position later.

The CU in the wave-based system or MD in relative-motioned-based system is also called locator of head, shortly locator. Usually there are two of them. With the first one, the second CU or MD is used for determining the sprayer array direction, so that the position of each sprayer/reader in the sprayer/reader array is determined.

The second aspect of the invention provides the method for recording image. The system based on this method takes the image digital data from any image surface to computer for storing and reproducing, and also by arbitrarily moving the hand-operation or robot-operation or vehicle carried apparatus, on the surface. All apparatuses and procedures in the systems are same as that in the image reproduction system, but use image reader/reader array instead of sprayer/sprayer array. Trigged by a trigger clock, the coordinate information and color data are taken from the image surface at the triggered moment and are sent back to the computer. The computer processes the information and data promptly or stores them into a file for processing lately. The computer inverses the coordinate information into coordinates. The coordinates at the triggered moment may not be just at a pixel on the pre-formatted pixel grids. So then the computer calculates the color values at all pixels on the pre-formatted pixel grids based on the obtained coordinates and color data, by using interpolation method.

In the third aspect of the invention provides the theories, concepts, ideas, and methods corresponding to each structure, embodiment, apparatus, and procedure, for positioning, processing and controlling the image reproduction and recording, including hardware signal processing and software data processing.

BRIEF DESCRIPTION OF THE DRAWINGS

A better understanding of the invention will be obtained by reading the detail description of the invention below, with reference to the following drawings, in which:

FIG. 19 is a flow chart of the position data processing and control for a single head.

DETAILED DESCRIPTION OF THE INVENTION

Figure 1:
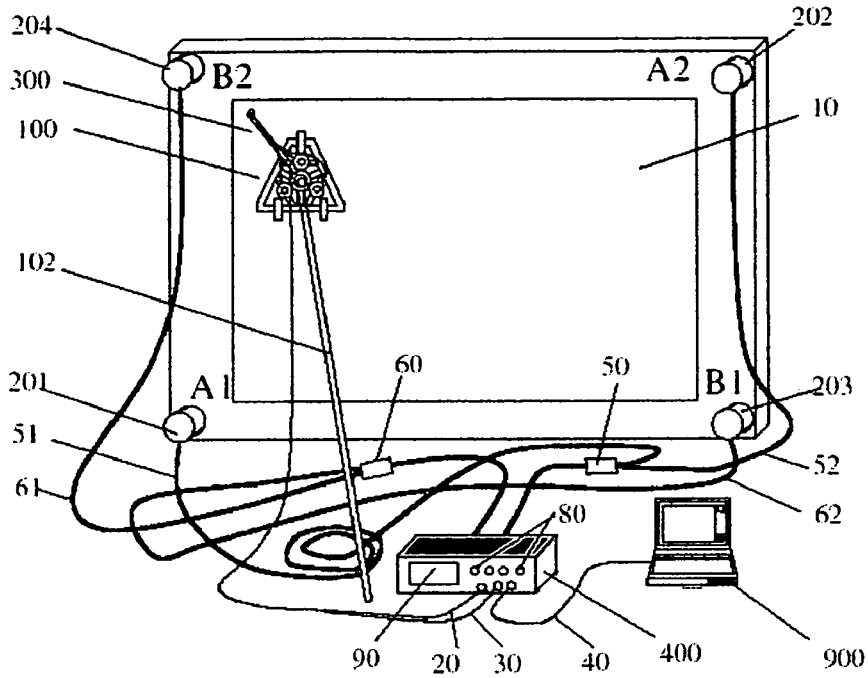
FIG. 1 is a view showing the constitution of one of the preferred embodiments for the image reproduction and recording system according to the invention, with the CU (communication unit) on the corners, and the color material tanks on the head carrier or in the cartridge that are build together with the head.

The present invention is to provide a method for image reproduction and recording with the flexibility, easiness, and convenience to use for a plurality of users from industries, offices and homes, and home decorations. The systems based on this method are flexible and consist of an easy hand-operation or robot-operation or vehicle carried apparatus, instead of the complex and costly mechanical apparatus-based systems in present conventional image reproduction and recording systems in plurality of uses.

<Dictionary>

For convenient in reading this invention, it is necessary to build a 'dictionary' for the definitions of some terms, as listed in the following:

(1) In "Flexible operations": "hand-operation" means operation by hand of a human being; both "robot-operation" (such as the 'spiderman'-like) and "vehicle carried operation" means the powered-apparatus-aided operation, but without mechanical-guide-apparatus (such as track guide for guiding the printing head or scanning head in the conventional printer, or scanner) for positioning, if the operation needs a power that exceeds the power of the human being, or if the environment of operation is not accessible for human being;

(2) The term "image generation, or generate image" means reproducing (printing, painting, spraying, and deposition) or recording (scanning, and reading) image or pattern on or/and from any surface.

(3) The term "image" in phases "image reproduction or image recording" has dual meanings: (a) any predetermined pattern or deposition to be reproduced, or any pattern or deposition to be recorded, which has already existed and was resulted from human's arts or natural's arts; (b) the image stored in computer, which could be recorded by scanner, or taken by digital camera, digital camcorder, etc.

(4) The term "head" in this invention means either sprayer for image reproduction or reader for image recording. Some time the "head" also means the part on which the head is installed;

(5) The term "sprayer" in this invention means the ink-jet, paint sprayer, or any other devices for material deposition. "Spray" or "spraying" means any action for material deposition;

(6) The term "reader" in this invention means any device that takes the image information from a predetermined pattern or deposition, such as the image sensor in an image scanner or in a camera. "read" or "reading" means any action of the reader;

(7) The "element" of an array is a general term referring to an element in one-dimensional array in positioning method description and claims. However, in image reproduction or recording system, it refers to a head in head array.

(8) The CU or MD built on head carrier is called head "locator" in claimed "image reproduction and recording system".

(9) However "positioning locator" in the claims of positioning methods is a general term and is not necessary only for "image reproduction or recording system";

(10) "Light" or "photon" means visible or invisible, coherent or non-coherent electromagnetic radiation from T-ray to X-ray;

(11) "Electromagnetic waves (EMW)" means all electromagnetic radiations from long wave up to 1 THz;

(12) "Wave" mean means all EMW and ultrasonic waves;

(13) "Information carrier" means RF wave or ultrasonic wave on which the information is ridding; while "carrier wave" means the light wave or millimeter microwave on which the RF is ridding (i.e. RF modulation);

(14) The term "in a space" or "in image space" means on 2D flat surface or 2D curved surface, or in our real space (3D). It is a well-known knowledge that 1D, is a line, 2D space is 2D plane and 3D space is our real space;

(15) The term "computer" means a programmable device (i.e. a generalized computer) for system and embodiment controlling.

(16) 'phase detector' means a mixer or a digital phase detector;

(17) "hand stick" means a device which provides the power to head-carrier for making head-carrier moving, it could be either hand-hold apparatus or powered-apparatus;

<System Constitution>

A method for image reproduction and recording is described below, by using some specified systems that are based on this method. The method will be understand clearly and fully by describing the system constitution, system operation, apparatuses, and the methods for positioning, processing and controlling, in detail with references to the accompanying drawings.

FIG. 1 is used here to show the constitution of one of the preferred embodiments for the wave-based method for image reproduction and recording according to the invention. The by using this method, one reproduces the image on the image area 10 of a surface based on image data stored in computer 900, or record the image data from image area 10 into computer 900, by arbitrarily pushing and pulling the "hand stick" 102 of head carrier 100 (or any hand-hold brush-like body), on the surface. The surface can be any surface, such as curved, sphere or flat surface. The head carrier can be a hand-operational apparatus with a "hand stick" 102, or can be a powered-apparatus-aided apparatus for huge applications, or can be robot operation, or vehicle carried operation, if the environment of operation is not accessible for human being.

For image reproduction, four communication units (CU) 201~204, used as the transmitters/receivers with marks (A1, A2, B1, and B2), are set at the four corners. The CU (details in FIGS. 3~7 later) set on the head holder 300 are used as the receivers/transmitters, respectively. The information carrier can be either radio frequency (RF), or RF carried on light from T-ray to X-ray, or ultrasonic wave. However, if RF is directly (i.e. not modulation) used as information carrier, the CU must be set at corners or edges and must be fairly far away from the boundaries of image area 10, due to the nonlinearity of phase dependence of the near-field.

For convenience, here, let us describe this case first: using the CU 201~204 as the transmitters and using the single CU (head locator) on head holder 300 as the receiver. The operation unit (OU) 400 produces signals and sends signal to CU 201~204, through cables 51,52, 61,62. The cables 51 and 52 are split from one source, and have the same length from the splitter 50 to A1 201 and A2 202, so that they have the same time delay. The same is applied for cables 61, and 62; they have the same length from the splitter 60 to B1 203 and B2 204. The CU 201~204 transmits the waves. The receivers receive the waves with phase or time information and send the message back to the OU 400 through cable 20. The hardware in operation unit 400 processes the message and converts the message into phase difference or time difference, and sends these data to computer 900 through cable 40. From these phase data, computer 900 inverses the coordinates of the position of the head locator (details in FIGS. 3,4,5) on head holder 300 by using positioning theories and formulas of this invention. According to the head position coordinates, computer 900 searches the pixel that is nearest to this position in image data file and takes the color data of this pixel, and sends the data to OU 400 through cable 40. Then OU 400 sends action commands and power to spray head on head holder 300 through cable 30. Any pixel on screen of computer 900, of which the corresponding image has been reproduced on the image area 10, will be marked by computer 900 and will not be reproduced again if the head on holder 300 moves back to the same position later.

For image recording, an image reader or reader array is installed on the head holder 300. The positioning procedures are the same as that for image reproduction, described above. Triggered by the trigger clock, the coordinate information and color data are taken from the image area 10 at the triggered moment and are sent back to computer 900 through OU 400. Computer 900 processes the information and data promptly or stores them into a file for overall processing lately. Computer 900 inverses the signal that carries the coordinate information into coordinates. The coordinates at the triggered moment may not be just at a pixel in the pre-formatted pixel grids. So computer 900 then calculates the color values at all pixels in pre-formatted pixel grids from the obtained coordinates and color data, by using interpolation method.

The transmitter and receiver can be swapped. The CU 201~204, A1, A2, B1, B2, can also be used as receivers (serve as receiving CU), while the CU on the head holder 300 can be used as transmitters (serve as transmitting CU). The details will be described in sections below.

The procedures described above are applicable for the all preferred and alternative constitutions described below.

Figure 2:
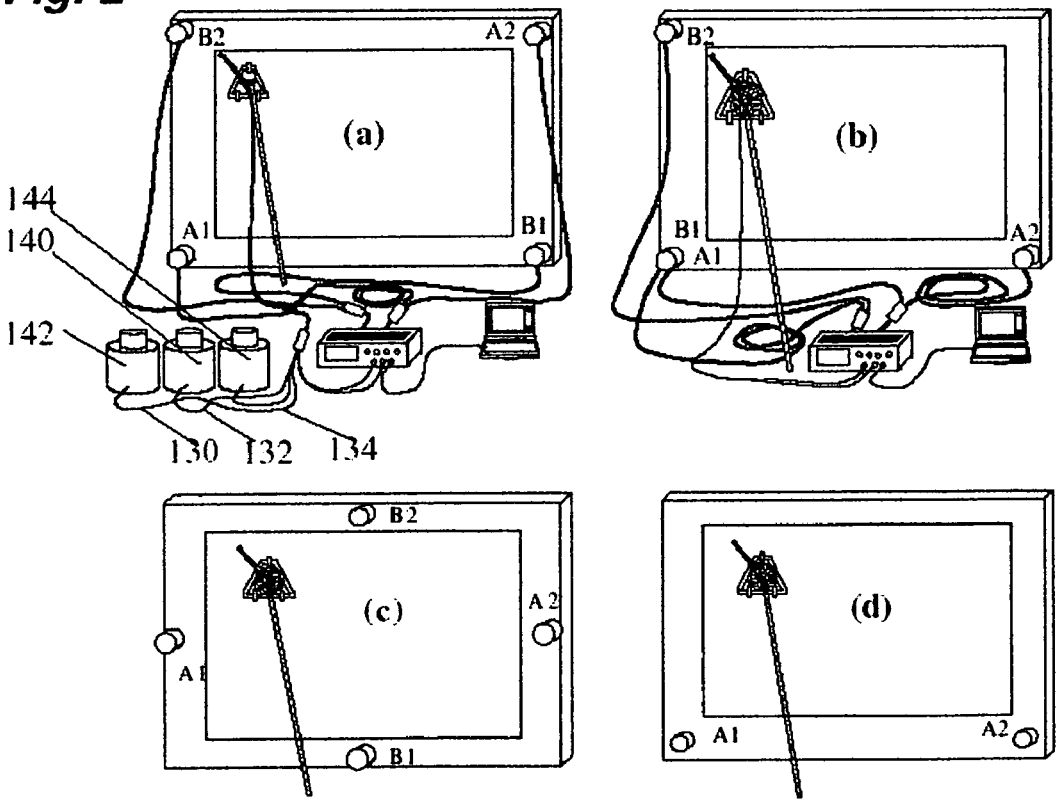
FIG. 2 is a view showing the constitution of other preferred embodiments for the system according to the invention: (a) the color material tanks on the ground, (b) three CU on the corners, (c) four CU on the middle edges, (d) two CU on the bottom corners.

FIG. 2 shows another preferred constitutions for 2 dimensional (2-D) applications according to the invention. The color material tanks are necessary for large images and are placed on the head carrier 100 (details in FIGS. 3, 4 and 5). However, for huge images, the color tanks 140,142 and 144 are placed on the ground or on a support platform. The color materials are transported to sprayers on the head holder 300, through tubes 130,132 and 134, as shown in FIG. 2 (*a*). In FIG. 2 (*b*) is shown an option to use only three CU at three corners, with CU A1 201 and B1 203 merged together. FIG. 2 (*c*) is an option to use four CU 201~204 on the middle edges, which provides the simplest positioning theories and formulas. For the time-based positioning, the embodiment shown in FIG. 2(*d*) is used; here only two CU A1 201 and A2 202 on bottom corners are used.

For 3-dimensional (3-D) applications, another one or two CU's need be installed at any points (except too close to the image surface) on z-axis of all the cases described in FIG. 1 and FIG. 2. The z-axis is an axis that is vertical to the 2-D frame plane (image surface), or the z-axis could be one edge of the 3-D frame. For all the cases described above, CU can be either fully or partially at either the middle edges or the corners of the frame, and the color tanks can be either on the head carrier 100, or on the ground, or on any support platform.

The cables used for transmitting the phase-doesn't-matter signal, color data, and operation commands between operation unit 400 and head 300 can be replaced by wireless communication.

For the relative-motion-based system, with the optical-image approach or mouse-technique approaches, there are no CU (201~204) and OU 400, and the cables between them. Instead of CU and OU, MD and OM are installed together with locator on head holder 300 and arbitrarily moving on the image surface. The OM (not shown in figures) is directly connected with computer 900 through a multi-path cable. Computer 900 periodically sends the commands to OM. OM executes the commands to read the motion information of the locators from MD, and organizes this information as time-sequences. Then OM sends these time-sequences to computer 900 by multi paths in parallel through the cable. Computer processes the information for locator positioning and determining the coordinates of the head in the head array. The OM executes the commander from computer to control the action (spraying or reading) of the head in head array. One of the preferred MD's comprises a two-dimensional array of camera-image sensors (M by N pixels), two lenses, and one laser. For recording system, OM reads out the image information at each image pixel on sensor array, and organizes this information as time-sequences and sends them to computer 900, and then computer stores this image information on disk. Also, any computer-mouse techniques can be employed as MD.

<Apparatus Constitutions and Operations >

Head carrier

Figure 3:
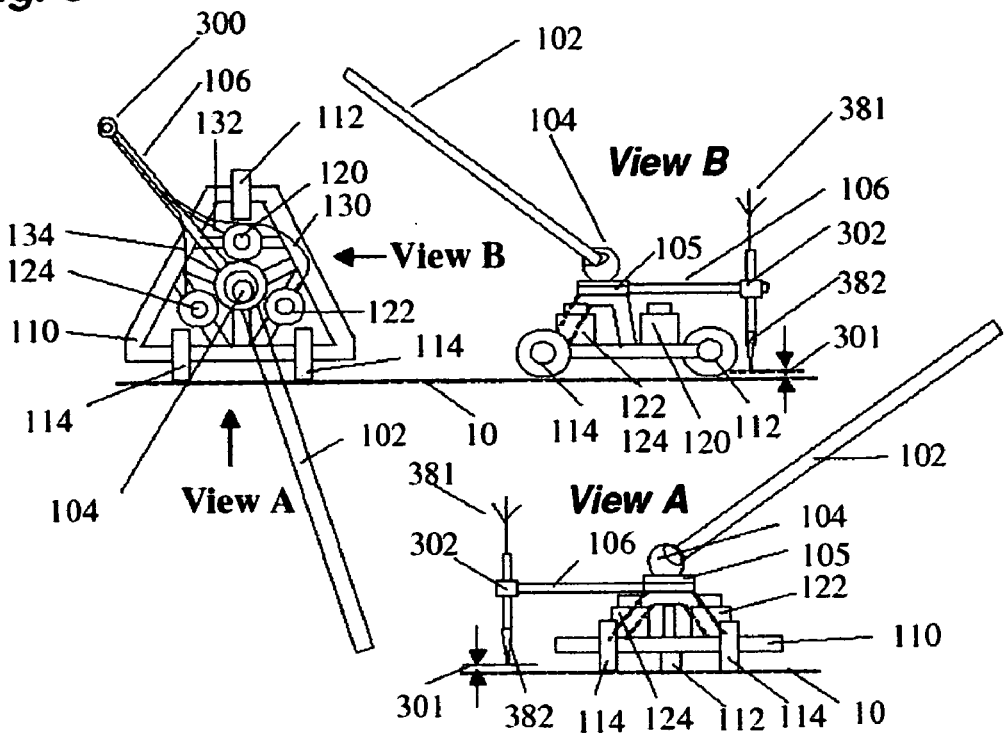
FIG. 3 is the schematic chart of one of the preferred embodiments for the head carrier with single head according to the invention.

FIG. 3 shows one of the preferred embodiments for the head carrier with single head according to this invention. The head carrier 100 is composed of a frame 110 (main body of head carrier, any shape), one front wheel 112, two rear wheels 114, "hand stick" 102, head arm 106, and head holder 300. The wheels (112, 114) enable the carrier 100 moving on the image area 10 freely, and guarantee a constant fly height 301 for the head 382 (sprayer or image reader) over surface 10. The "hand stick" 102 is connected with the head carrier 100 by a joint 104, and the stick 102 can freely rotate about joint 104. The head arm 106 is connected with the head carrier 100 and can rotate about the axle 105 by hand-operation, for flexible application in various situations. The CU 381 and the head 382 are installed on the head holder 300. Head holder 300 is supported by head arm 106 at one end of the arm. For small image applications, the color materials are stored in the container built-in with the sprayer or color cartridges. For large image applications, three (or four if an additional black tank is needed for color quality) color tanks 120 (cyan), 122 (magenta), and 124 (yellow) are installed on the head carrier 100, moving together with the head carrier. The color materials are transported to the head from the tanks (120, 122,124) through color tubes 130,132 and 134. For huge image applications, the color materials are transported to the head from ground tanks 140,142,144 (FIG. 2 (*a*)) through color tubes 130,132 and 134.

Figure 4:
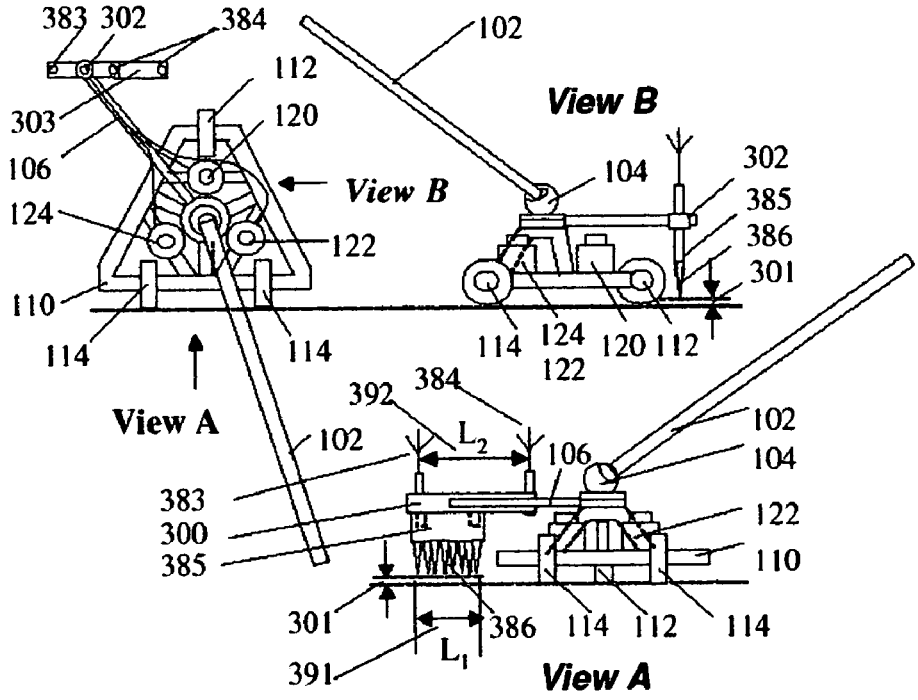
FIG. 4 is the schematic chart of one of the preferred embodiments for the head carrier with head array according to the invention.

FIG. 4 is used to show one of the preferred embodiments for the head carrier with head array according to this invention. The differences of this head carrier from the one described in FIG. 3 are in the head holder 300 and head cartridge 385 (instead of single head). A number of heads are built on the head cartridge 385 and form a head (sprayer or reader) array 386. The image resolution (IR) is determined by head density in head array, which is determined by the number of heads in the array and the array length L1 (391). Two CU (383, 384) (i.e. two head locators) are installed on the head holder 300. The holder extension 303 is needed to hold one of the CU, 384, so as to extend the distance L2 (392) between two locators, 383 and 384. The purpose of using this extension is to increase the accuracy in position determination of each head in the head array 386. The extension 303 can be added to either side of the head holder 300, depends on the convenience. The head holder 300 can rotate about the axle 302 by hand-operation, by 360°, for various situations of application.

Figure 5:
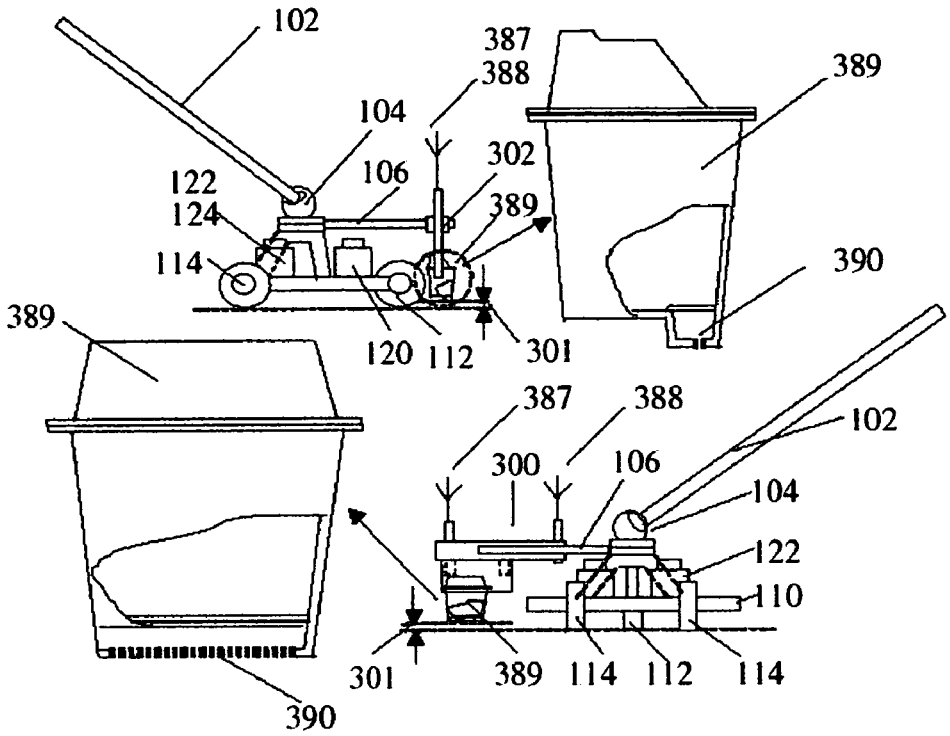
FIG. 5 is the schematic chart of one of the preferred embodiments for the head carrier with sprayer array on ink-jet cartridge according to the invention.

FIG. 5 is used to show another preferred embodiment for the head carrier with sprayer array built-in an ink-jet cartridge according to the invention. The only difference from the one described in FIG. 4 is that a color ink-jet cartridge 389 with sprayer array 390 is now used.

Communication Units

Figure 6:
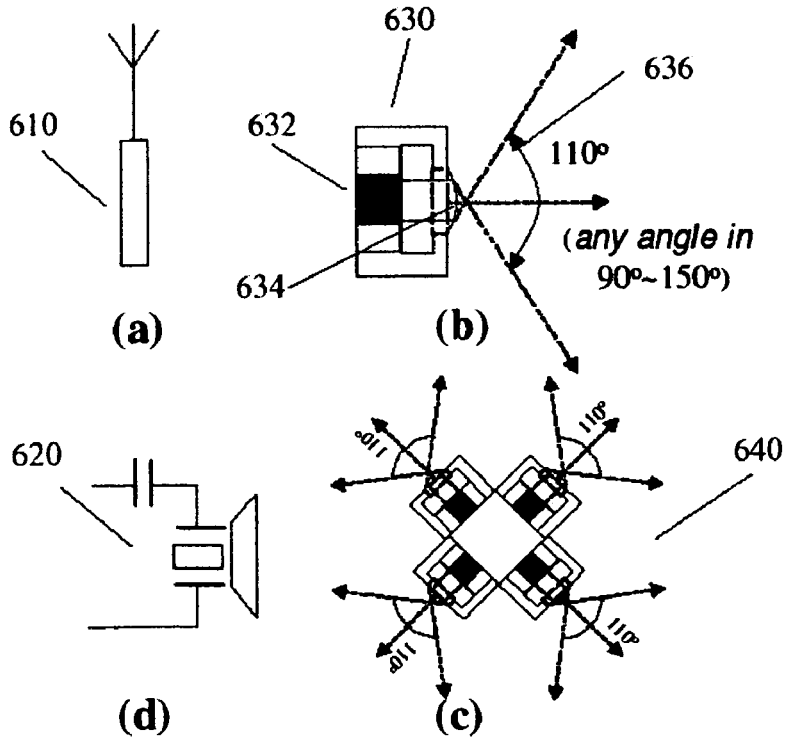
FIG. 6 is the schematic chart of the preferred embodiments for the transmitting CU's: (a) Radio frequency (RF) antenna, (b) single-light-source transmitter, (c) four-light-source transmitter, (d) ultrasonic transmitter.

The preferred options for transmitting CU (i.e. transmitters) according to this invention are shown in FIG. 6, including (a) Radio frequency (RF) antenna 610, (b) single light source (Laser or LED) 630, (c) multi light source 640 (four is shown in figure), and (d) ultrasonic transmitter 620.

The RF antenna 610 is used as the transmitter for RF-based system design. The wavelength of the lowest level RF should equal the size of image area 10. Here is an example:

sizes of 100 meters, 30 meters, 3 meters, 10 centimeters and 1 centimeter are corresponding to RF frequency 3 MHz, 10 MHz, 100 MHz, 3 GHz, and 30 GHz, respectively. If the technique for current-phase unwrapping processing is used, the frequency can be higher.

For applications with larger image area, the lower frequency is used. Therefore, the RF can be carried on (i.e. modulates) some extremely higher frequencies—millimeter microwave, where the frequency allocation is empty and the use of these frequencies is unlicensed (such as those at peak absorption of atmosphere), so as to avoid to be interrupted with public communication and military frequencies. In these cases, the same procedures as that used in light-based system described below are applicable, except the generator, transmitter, and receiver of carrier wave.

For the light-based systems, the RF is carried on the light wave by amplitude modulation or frequency modulation. The light is emitted from the emitter 632, called single-light transmitter. For 2D application, by a cylindrical lens 634, rather than a spherical lens, the light is uniformly diversified to the region with an angle 636 (any angle between 90° and 150° is applicable, but 110° is preferred). The design of lens and of light direction makes the light divergent as less as possible in the direction vertical to the paper plane. The single-light transmitter 636 is used for the system of which the transmitters are installed at the corners of the image plane. Multi-light transmitter 640 is built by number of single emitters 630, and is used for the systems of which the transmitter is installed on the head holder 300. The ultrasonic transmitter 620 is employed for the time-based systems. For 3D application, the lens is spherical and the six-light transmitter is used.

Figure 7:
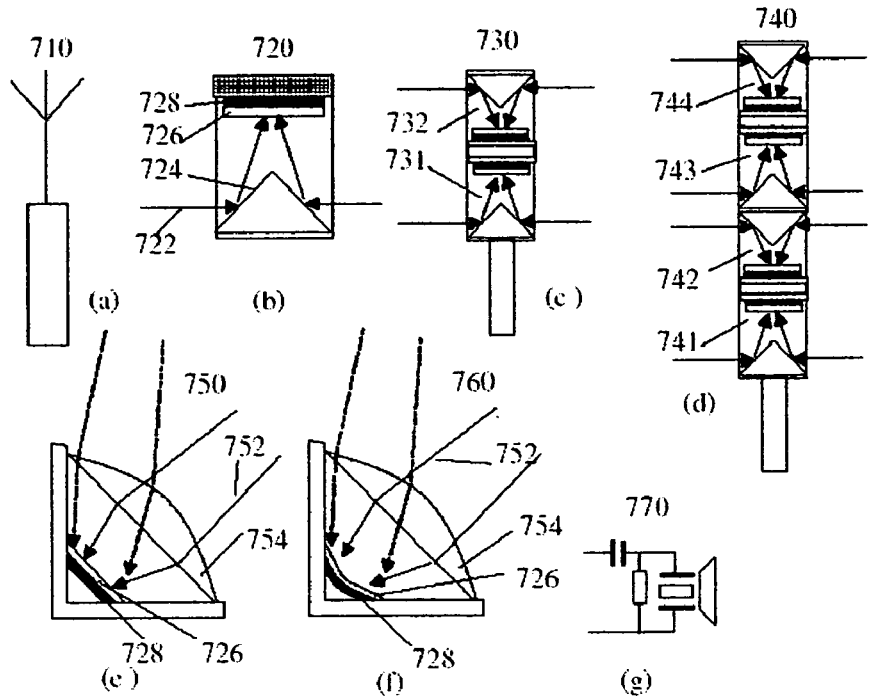
FIG. 7 is the schematic chart of the preferred embodiments for receiving CU's: (a) RF antenna, (b) single-photon-detector receiver, (c) two-photon-detector receiver, (d) four-photon-detector receiver, (e) corner single-photon-detector, (f) corner single-photon-detector with curved substrate, (g) ultrasonic receiver.

FIG. 7 is used here to show the preferred embodiments for receiving CU (receivers) according to this invention: (a) RF antenna 710, (b) single-photon-detector 720, (c) two-photon-detector receivers 730, (d) four-photon-detector receiver 740, (e) corner single-photon-detector 750, (e) corner single-photon-detector with a curved substrate 760, and (g) ultrasonic receiver 770. Due to the reciprocal principle of electromagnetic theory, those described in RF transmitters above are applied for RF receivers 710. The RF that is carried on an extremely high frequency (millimeter microwave) is demodulated by heterodyne or homodyne techniques.

For the systems of which the receiver is on the head holder 300, the two-photon-detector receiver 730 (three-photon-detector for 3D), or the four-photon-detector receiver 740 (and six-photon-detector for 3D), is used. They are built from a single-photon-detector 720. The latter is made up of photon sensor (photon detecting material) 728, light wavelength-selection filter 726, and cone mirror 724. The cone mirror 724 reflects the light 722 from all directions to the filter 726 and photon sensor 728. The current signal is generated from the sensor and is sent to the operation unit 400. Inside the sensor, a pre-amplifier may already be built in.

For the systems of which the receiver is at the corner of the image plane, the single corner photon-detector 750, or the one with a curved substrate 760 is used. The light 752 from different directions is focused on the photon-sensing material 728 by the lens 754, so as to increase the sensitivity, as shown in FIGS. 7 (*e*) and (*f*). Before the sensor, there is also an optical wavelength-selection filter.

The ultrasonic receiver 770 is employed if the ultrasonic transmitter 620 is used in the system.

Motion Detector and Operation Module

Figure 8:
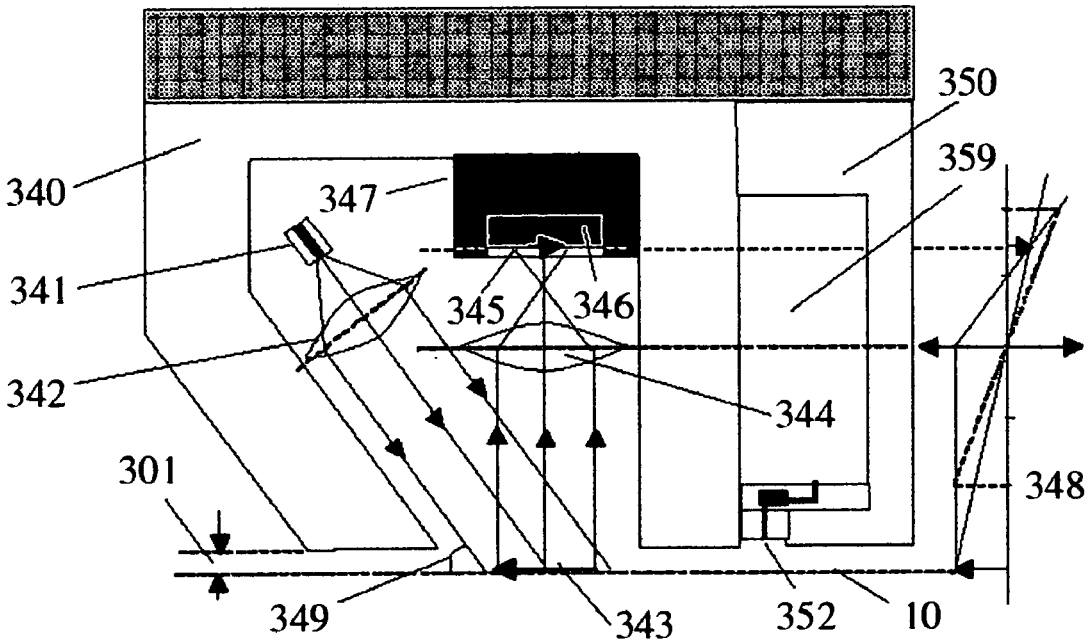
FIG. 8 is the schematic chart of one of the preferred embodiments for relation motion detector (MD).

For the relative-motion-based system, the head includes a motion detector (MD), an operation module (OM), and a sprayer or/and a reader. The preferred apparatus for the MD is the detector of optical image motion (340), as shown in FIG. 8. The MD is built together with the sprayer head 350 or/and recording head (not shown in the figures). The container 359 in sprayer head 350 is a buffer for ink or paint material, which provides the ink or paint material for the sprayers in sprayer array 352. The optical image motion detector 340 comprises laser 341, lenses 342, 344, and camera pixel sensor array 346. The laser 341 is installed at a focus of the lens 342, so the light is converted into parallel light beams and projects onto the surface, where is the path of head locator on image area 10. By lens 344, the optical image of the object (a 'micro' texture) 343 (any patterns, roughness distribution on the surface) appears on the surface 345 of the camera pixel sensor array 346. The light paths 348 for the image system are shown on the right side. The distance between the object 343 and the center of lens 344 is beyond two focus length of lens 344, while image 345 of the object is in between one and two of the focus length. The OM with a small volume (not shown in the figures) is installed together with the sprayer/reader and MD. OM executes the commands from the computer to read the motion information from MD, and organizes the information into time-sequences. Then OM sends these time-sequences data to the computer by multi-paths in parallel. OM also executes the commands from the computer to control the action of the head, after the computer finishes the processing.

For the recording system, the constitution is the same; the sprayer-array is replaced by the reader-array.

<System Operations>

Figure 9:
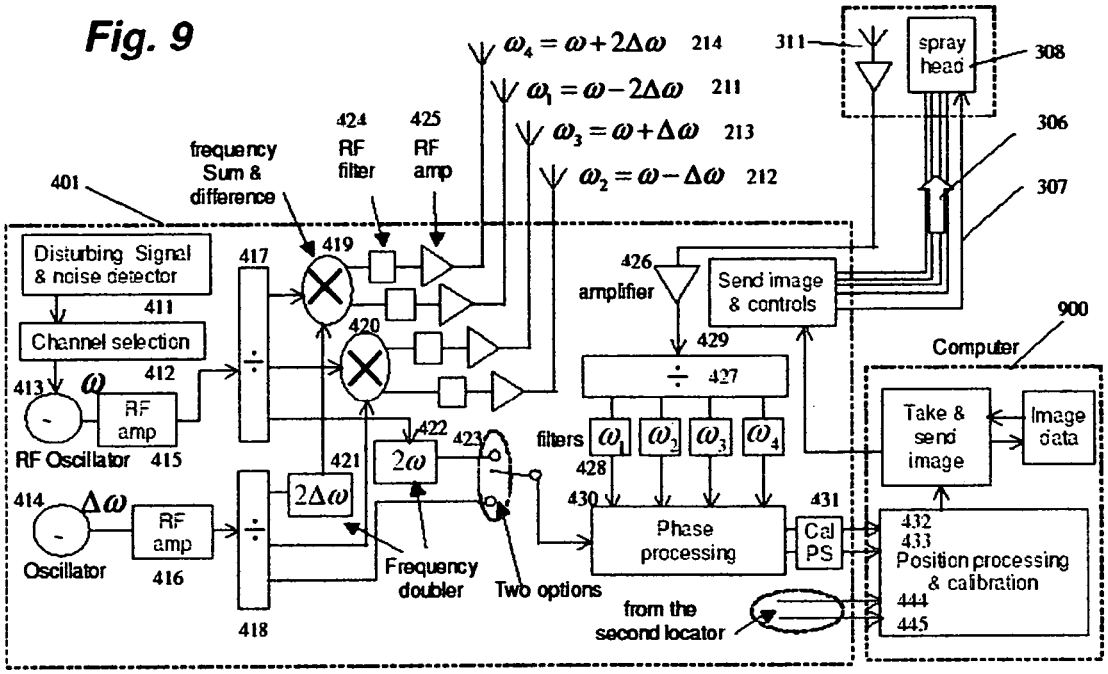
FIG. 9 is a schematic block diagram of the control and processing for one of the preferred RF-based system according to the invention.

The procedures of controlling and processing for one of the RF-based system according to the invention is shown in FIG. 9. The RF is directly used as the information carrier. The functions of operation unit (OU) 400, of computer 900, and of head 300 are shown in the frames of the left dish-line 401, the right dish-line, and the top dish-line, respectively. Before the system is going to work, the noise detector 411 searches the low noise RF channels. According to the channel selection 412, the frequency $\omega$ (higher) and $\Delta\omega$ (lower) is determined (by using these two frequencies, the frequencies $\omega_1$, $\omega_2$, $\omega_3$, $\omega_4$ for four RF channels are generated). The oscillators 413 and 414 are tuned to these two frequencies, and amplified by amplifiers 415 and 416. The higher frequency is split into three by splitter 417. Two of them are sent to mixers 419 and 420 and one of them is sent to frequency doubler 422 and then to a switch 423 (optional). The lower frequency is also split into three by splitter 418. One of them is sent to mixer 420 directly and the second is sent to mixer 419 after frequency doubler 421. The third one is sent to a switch 423, which is connected to phase processor 430. The two mixers provide the sum and differences of the two inputted frequencies. With filters 424, four frequencies ($\omega_1$, $\omega_2$, $\omega_3$, $\omega_4$) are separated and are sent to four transmitting antennas 211~214 at A1, A2, B1 and B2 shown in the previous figures. All four RF channels are amplified by amplifiers, 425. The receiver 311 receives the four signals from the four transmitters (411–414). After the band amplifier 426, the amplified four signals are split into four paths by splitter 427. The band pass filters, 428, allow only one frequency pass through each one of them. Phase processor 430 decodes the phase differences between A1 and A2, and the phase differences between B1 and B2, if the switch is turned to down side. Or, phase processor 430 decodes the phase sums of A1 and A2, and the phase sums of B1 and B2, if the switch is turned to up side. More details about the phase processor are described later with FIG. 11.

Phase calibration can be done by either the software in computer 900, or by the phase calibrator 431 before signal goes into computer 900. The same procedures for signal processing are applied for the receiver on the second locator shown in FIG. 4 (384) or in FIG. 5 (388). Computer 900 receives two groups of the phase messages for the positions of the two head locators (i.e. the antenna receivers), (432, 433) and (444,445).

Computer 900 processes the phase data by inverting the coordinates of the positions of the two locators from the phase data, which is based on the positioning theories and formulas of this invention. According to the coordinates of the two locators, computer 900 calculates the coordinates of each of the head in head array (386, in FIG. 4) by using interpolation method. According to the position of each head, the computer 900 searches the pixel in the image data file that is nearest to this position and takes the color data of this pixel, and sends the data to control unit 429. Then the control unit 429 sends commands of action and power to head 308 through color cables 306 and power cable 307.

Figure 10:
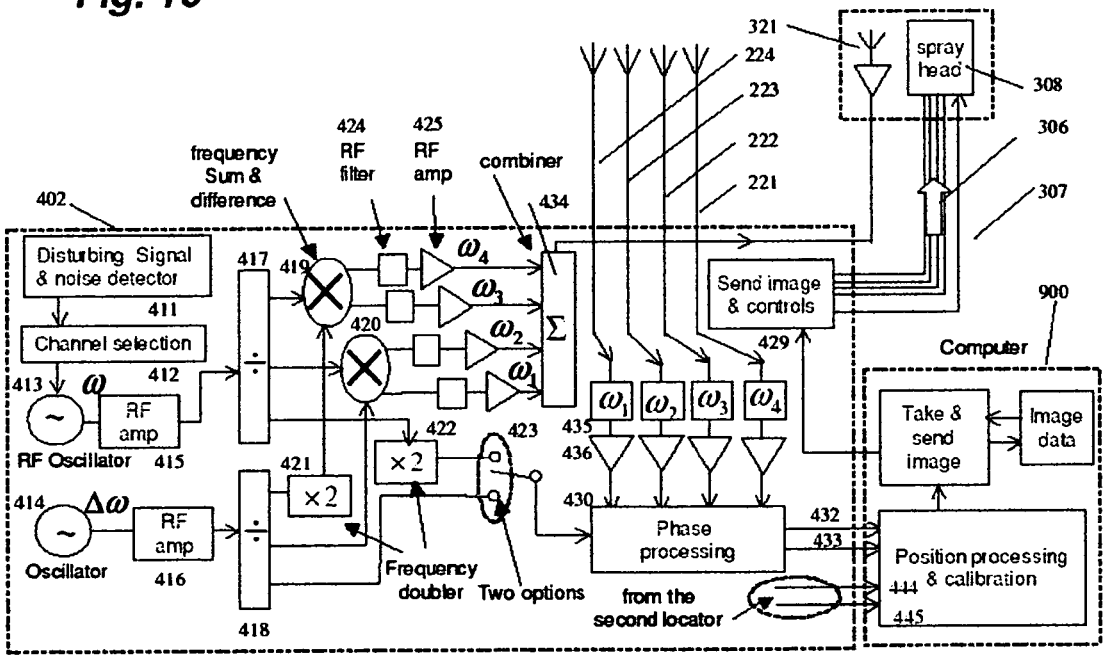
FIG. 10 is a schematic block diagram of the control and processing of another of the preferred RF-based system according to the invention.

FIG. 10 shows the procedures of controlling and processing for another RF-based system according to the invention. The difference here is that the transmitter and receiver are swapped from the system described in FIG. 9. The four RF channels are combined together by combiner, 434, before being sent to the transmitting antenna 321. The four receiving antennas receive the signals and send the signals to four band-pass filters, 435, which allow only one frequency to pass through each one of them. The four channels are then sent to phase processor 430 after being amplified by amplifiers, 436.

Figure 11:
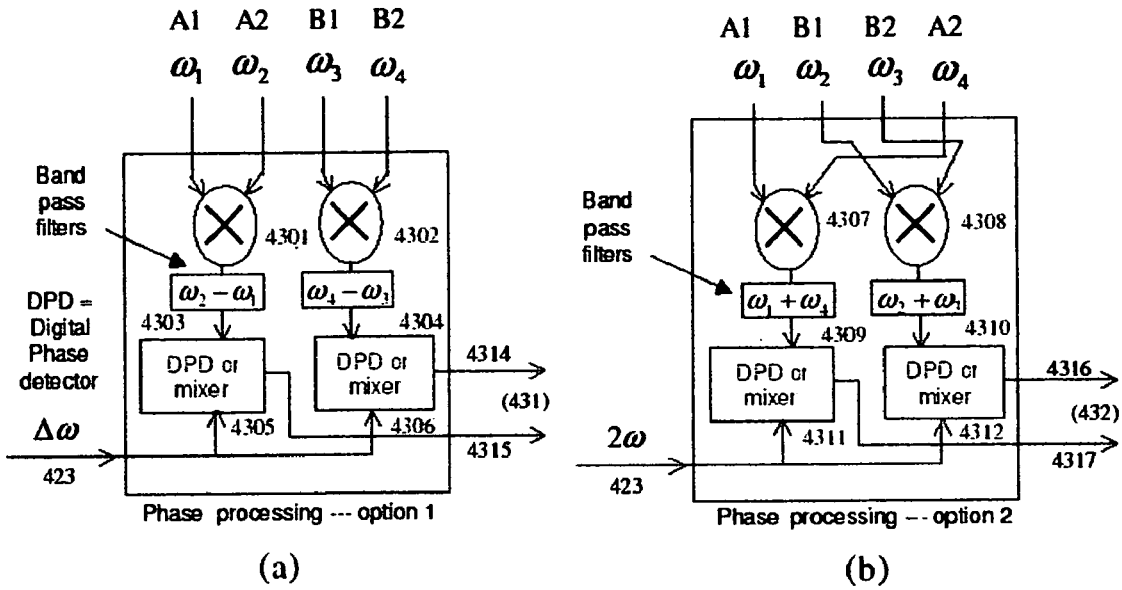
FIG. 11 is a schematic block diagram of phase processing for the direct-RF-based systems.

One procedures of phase processing for the RF-based systems are shown in FIG. 11 (*a*), the first two frequencies are conducted to mixer 4301, which produce another two frequencies—the sum and difference of inputted frequencies. The band pass filters 4303 filter out the sum frequency. At this point, the signal with the difference frequency carries the phase difference between A1 and A2. The digital phase detector (DPD) or mixer 4305 decodes the phase difference by homodyning with the signal from 423. The phase difference 4315 (A2–A1) is sent to the computer. The same is applied for the other two frequencies. The output phase difference 4314 (B2–B1) is sent to the computer.

Another phase processing procedure for the RF-based systems is shown in FIG. 11 (*b*). The largest and the smallest frequencies are conducted to mixer 4307, which also produces two frequencies, the sum and difference. But the band pass filters 4309 filter out the difference frequency, and pass the sum frequency. At this point, the signal with the sum frequency carries the phase sum of A1 and A2. The digital phase detector (DPD) or mixer 4311 decodes the phase sum by homodyning with the signal from 423. Then the phase sum 4317 (A2–A1) is sent to the computer. The same is applied for the two middle frequencies. The phase sum 4316 (B2–B1) is sent to the computer.

Figure 12:
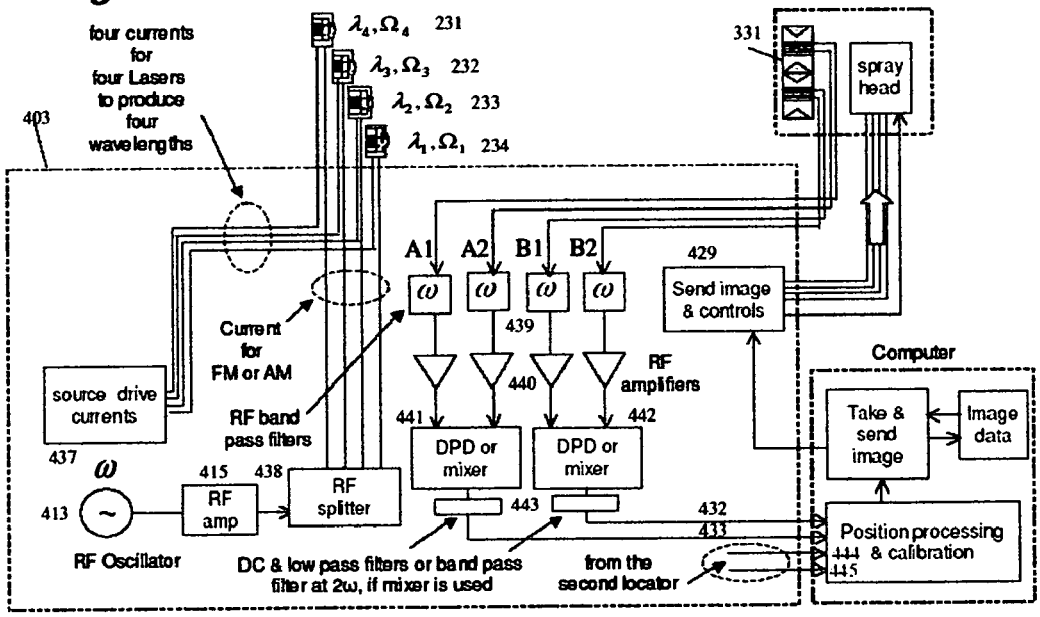
FIG. 12 is a schematic block diagram of the control and processing of one of the preferred modulation-based systems according to the invention, with FOUR wavelengths/frequencies.

FIG. 12 shows the procedures of control and processing for one of the modulation-based systems according to this invention. In this system, RF is used as modulation. The carrier wave of this RF wave is light or millimeter microwave. For the millimeter microwave carrier, the frequency with peak absorption (60~70 GHz, 120~130 GHz, and 170~180 GHz, for example) is preferred but not limited, where the frequency allocation is empty and the use of frequency is unlicensed, so as to avoid to be interrupted with public communication and military frequencies. Here, the laser, as carrier-wave, is used for illustrations. The laser driver 437 provides four currents to four lasers (231~234) to emit four wavelengths or frequencies $\Omega_1$, $\Omega_2$, $\Omega_3$, $\Omega_4$ of lasers. The lights from all lasers are modulated by RF signals with one frequency $\omega$ for one level of RF. The RF signal is generated by the RF oscillator 413 and amplified by amplifier 415. The RF splitter 438 splits the RF signal into four paths and sends the RF to each laser (231~234), so that the light power or light frequency is modulated. The four-photon-detector receiver 331 converts the light power into RF currents (either coherent or non-coherent detection is used, but here using non-coherent as example). Each of the detectors has a different optical filer (726 in FIG. 7) to allow only one of the four frequencies $\Omega_1$, $\Omega_2$, $\Omega_3$, $\Omega_4$ to pass through. The currents are sent back to the four RF band pass filters 439 that allows RF frequency $\omega$ pass through. After amplified by amplifiers 440, the phase differences of first two signals and the last two signals, 433 and 432, are recovered by DPD 441 and 442, respectively, and are sent to computer 900. If the mixer is used at 441 and 442, the filters 443 are needed, before the signals are sent to computer 900, for filtering out higher frequency if the phase difference is used, or for filtering out the lower frequency if the phase sum is used.

In the cases of using millimeter microwave as the carrier wave, the same procedures for controlling and processing in the light-based systems described above and below are applicable, except for the generator, transmitter and receiver of carrier wave.

In the cases of using a mixer at the last step before the message goes into computer 900 (above and below), the output of mixer is not directly the phase difference or phase sum, but is the sinusoidal function of them. So the computer software converts the message into phase difference or phase sum for these cases.

Figure 13:
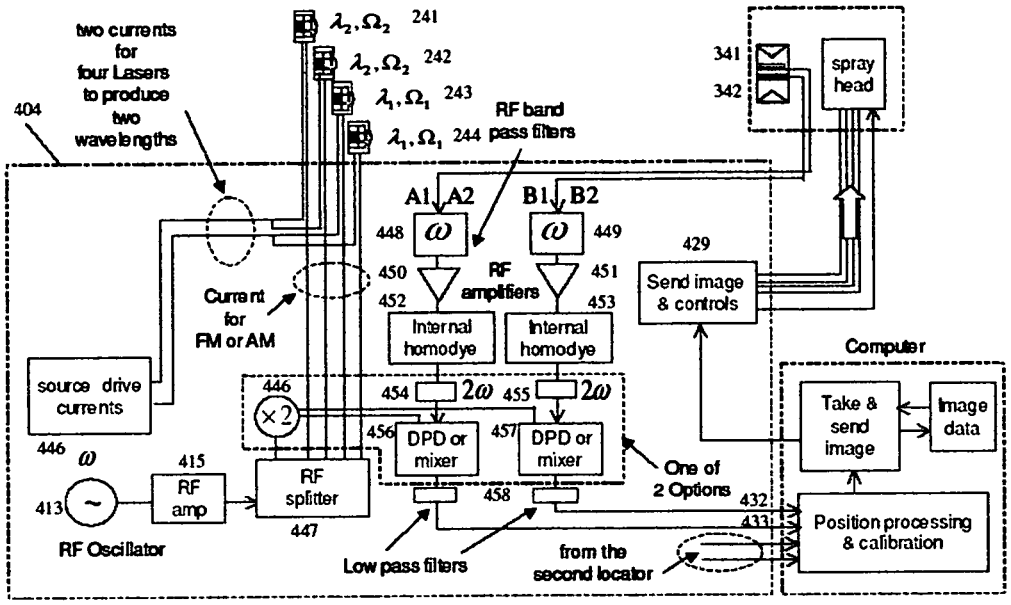
FIG. 13 is a schematic block diagram of the control and processing of another of the preferred modulation-based systems, with TWO wavelengths/frequencies.

The procedures of control and processing for another light-based system, but with two wavelengths, are shown in FIG. 13. The transmitters 243, 244 at A1 and A2 emit the same light wavelength (or frequency $\Omega_1$), while transmitters 241, 242 at B1 and B2 emit the same frequency $\Omega_2$ One of the two receivers, 341, filters out the second light frequency and detects the two signals that are carried by the first frequency $\Omega_1$ (from A1 and A2), and then sends the two detected RF signals to a RF band pass filter 448. The two signals are internally homodyned at mixer 452 after the amplifier 450. The output from the mixer 452, after a low pass filter 458, is a sinusoidal function of the phase difference, which is sent to computer 900. The other receiver, 342, filters out the first frequency and the sends the two detected RF signals (from B1 and B2, and carried by the second frequency $\Omega_2$) to a RF band pass filter 449. The dish-line-framed part (446, 454, 455, 456, 457) is an option for using the phase sum.

Figure 14:
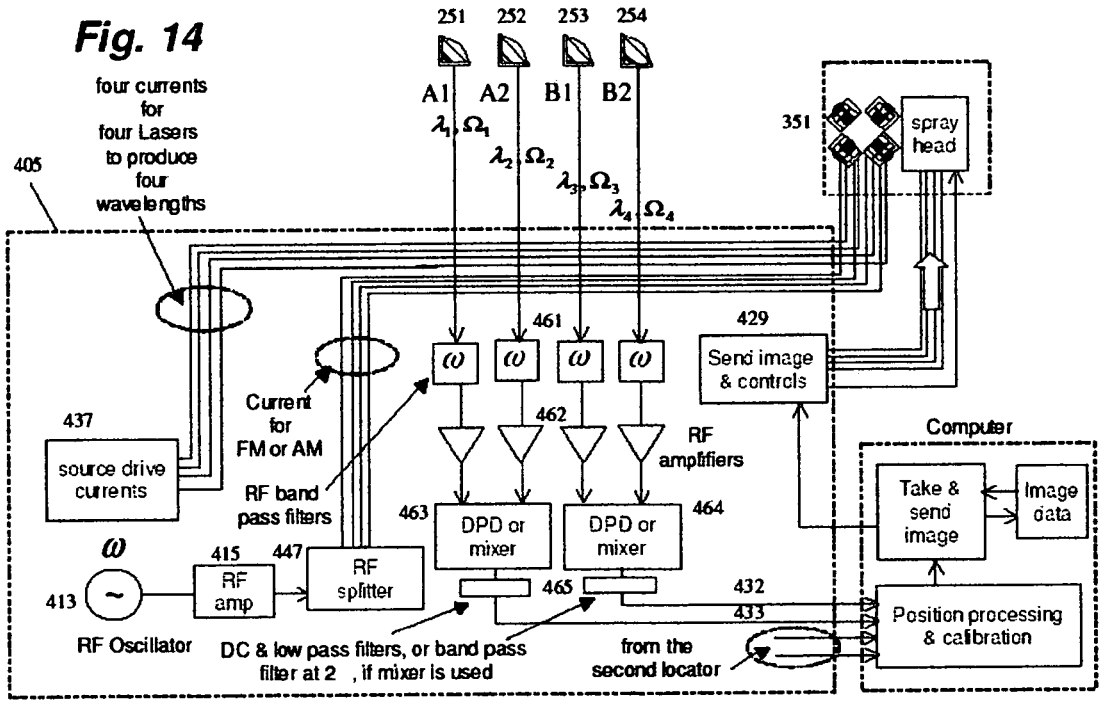
FIG. 14 is a schematic block diagram of the control and processing of another of the preferred modulation-based systems, with four wavelengths/frequencies.

The control and processing of another light-based system, with four wavelengths, is shown in FIG. 14. The difference from the system described in FIG. 12 is that the transmitters and receivers are swapped. The four-light-source transmitter 341 is installed on the head holder 300. Four corner receivers 241~244 are used.

Figure 15:
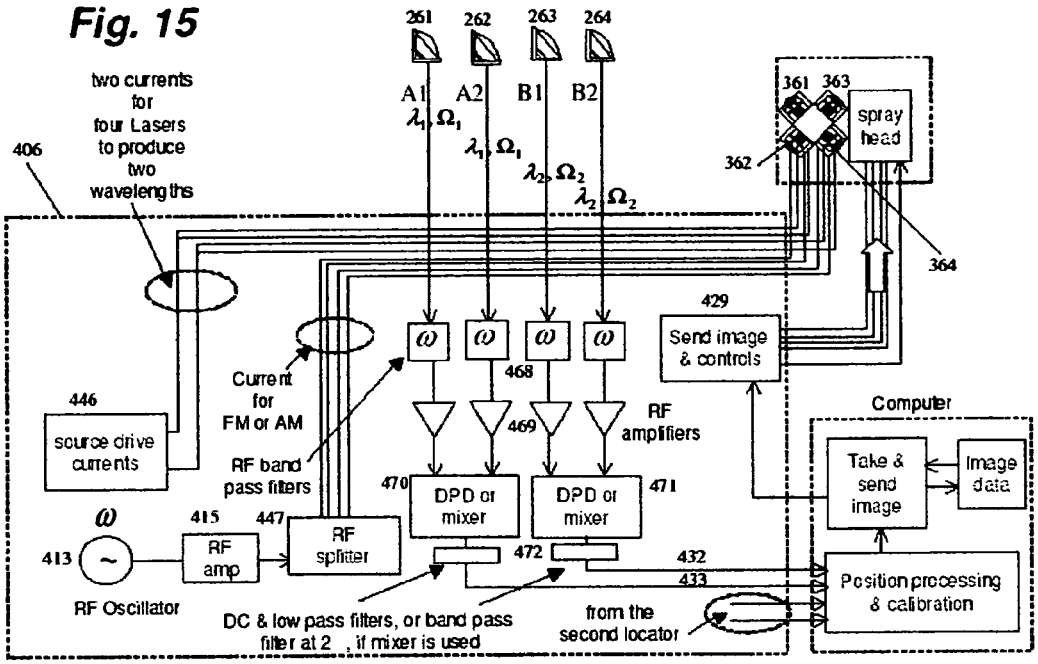
FIG. 15 is a schematic block diagram of the control and processing of another of the preferred modulation-based systems, with two wavelengths/frequencies.

FIG. 15 is a schematic block diagram of the control and processing of another light-based system. All the procedures for this system are the same as that in the system described in FIG. 14, except that only two wavelengths or frequencies are used.

Figure 16:
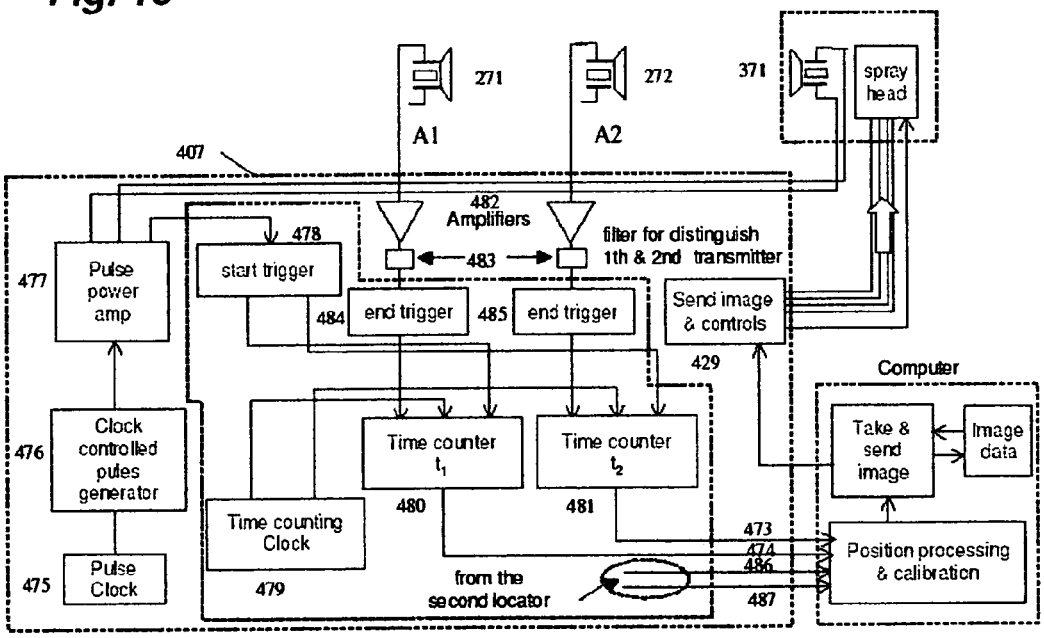
FIG. 16 is a schematic block diagram of the control and processing of one of the preferred time-based systems with an ultrasonic approach.
Figure 17:
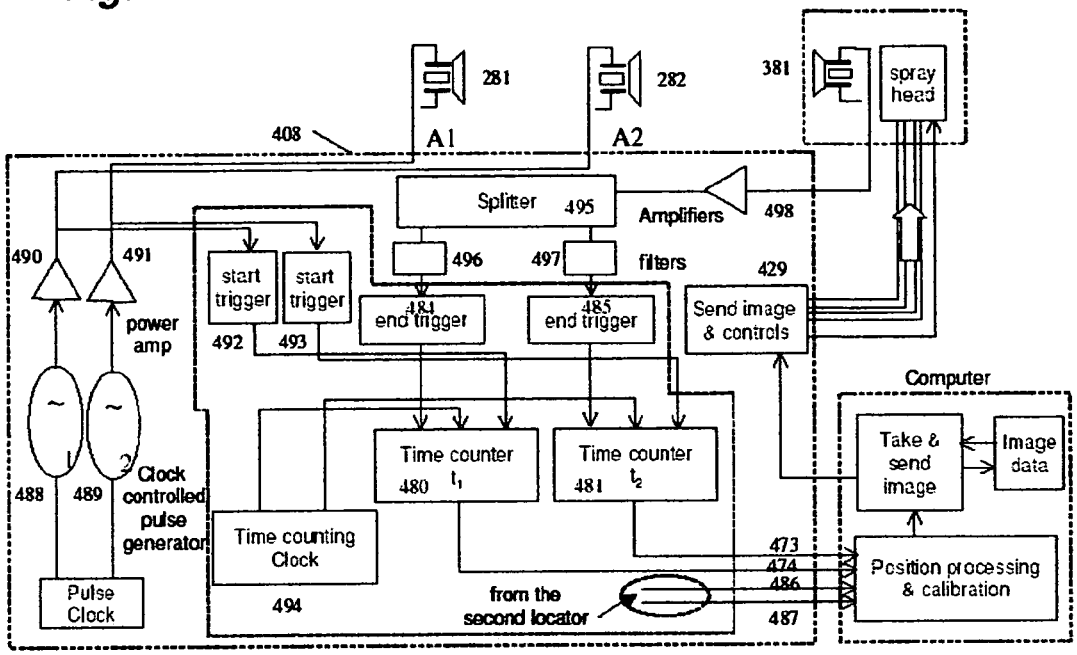
FIG. 17 is a schematic block diagram of the control and processing of one of the preferred time-based systems with another ultrasonic approach.

The system with its alternatives described in FIGS. 9 to 15 is based on the phase measurement approaches, called phase-based system. The system can be also based on the measurement of time difference, called time-based system. The information carrier for the time-based system is, usually, ultrasonic wave, but it can be also any kind electromagnetic wave (light, RF or millimeter microwave) as long as we have fast-enough clocks in the future or for huge image applications. Here, the system is illustrated by an ultrasonic-based approach as shown in FIG. 16 and FIG. 17. The clock 475 periodically sends commands (triggers) to the pulse generator 476, which generates a pulse-modulated current with an ultrasonic frequency. After the current power is amplified at amplifier 477, the current is sent to transmitter 371. The ultrasonic pulse is transmitted out from transmitter 371 and is received by receivers 271 and 272. In the meantime, the power amplifier 477 has also an output signal for the start trigger 478 to trigger the time counters 480 and 481, so as to start time-counting at the moment the ultrasonic wave is sent out. After the receiver 271 and 272 receive the pulse, the signal is immediately (speed of electromagnetic field is far greater than the speed of sonic) amplified by the amplifiers 482, and is sent to triggers 484 and 485 to stop the time-counting. Then the time counters 480, 481 send the time differences to computer 900. The ultrasonic frequency filters 483 are used to distinguish the pulse from the other transmitters (384 in FIG. 4, or 388 in FIG. 5) on head holder extension 303 in FIG. 4, because the two transmitters are driven by different ultrasonic frequencies.

FIG. 17 is used to show the control and processing of the time-based system with another ultrasonic-based approach. The difference from the system described in FIG. 16 is that the transmitter and receiver are swapped. More clearly, the receiving CU 381 is on the head holder 300 rather than the transmitting CU on the head holder. Two ultrasonic pulse generators 488 and 489 are used to produce two driving currents with different frequencies. Therefore, the two ultrasonic pulses with different frequencies are transmitted from the transmitters 281 and 281. The mixed signal from receiver 381 after amplified by amplifier 498 is split into two paths by splitter 495. Each of the filters, 496, or 947, blocks out the other frequency and sends the pulse to triggers 484 and 485 to stop the time-counting.

The Doppler effect is an alternative used for detection of relative motion. Only two transmitting CU (transmitters) at the bottom corners (such as A1, A2 in FIG. 2(*d*)) and two receiving CU (receivers on the head holder) as two locators are used. Instead of producing pulse-modulated ultrasonic wave or electromagnetic wave, the generators 488, 489 in FIG. 17 generate an oscillation current with two frequencies a fair away from each other, and the transmitters 281, 282 in FIG. 17 radiate CONTINUOS ultrasonic waves or electromagnetic wave. Receiver, 381 in FIG. 17, is replaced by a Doppler-Frequency-Detector. When receiver 381 is moving around in the two wave-fields, the Doppler frequencies, which carry the information of two velocity components along two directions, are detected. One direction is from one transmitter A1 (281) to the receiver 381; the other direction is from the other transmitter A2 (282) to the receiver 381. So the angles of two directions are timely changing while receiver 381 is moving. The Doppler frequencies are sent to computer 900. Computer 900 converts the two Doppler frequencies into velocity components and calculates the two displacement components of the receiver (i.e. locator) by integrating the velocity components. Then from the displacement components, the relative position of the locator is determined.

The other alternative positioning method for image reproduction and image recording system is to use any mouse-technique-based positioning method for determining the relative position of the locator.

<Computer Processing>

Figure 18:
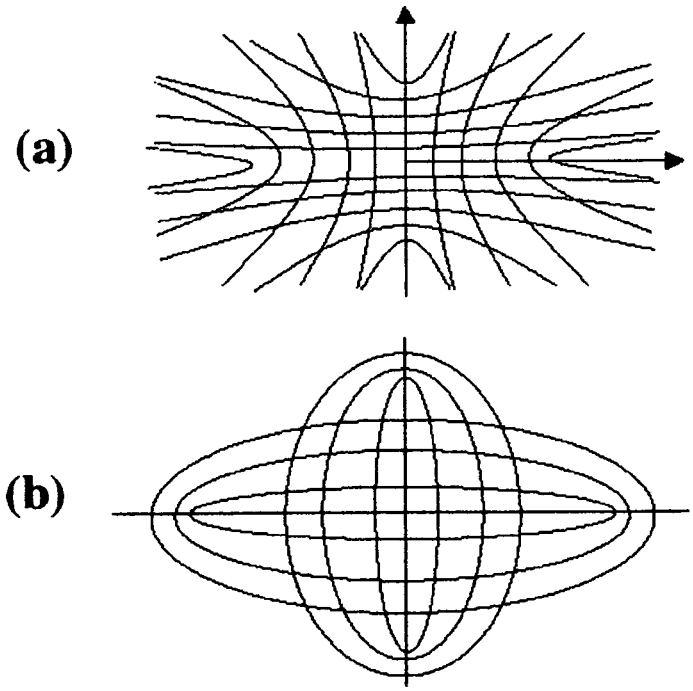
FIG. 18 is a schematic chart of the contour curves for constant phase differences (hyperbola), and constant phase sum (ellipse).

INTRODUCTION—Computer processing procedures are classified into two cases: using phase difference, or using phase sum. Also, there are two kinds of dependence of phase on the coordinates of the locator in the image area 10. For the modulation-based systems described above, the dependence of phase on the coordinates is linear; while for the systems that directly use RF described above, the dependence is nonlinear due to phase nonlinearity of the near-field and the distortion from the boundary conditions. For the case of linear phase dependence and using phase difference, the contour curves for constant phase differences are a class of hyperbola curves, as show in FIG. 18(*a*). While, for the case of linear phase dependence and using phase sum, the contour curves for constant phase sum are a class of ellipse curves, as show in FIG. 18(*b*). All the hyperbolas or ellipses have the common foci at four CU's (A1, A2, B1, B2), this is the general conclusion whenever the CU's are located at the corners or at the four middle edges. This invention provides the general theories, relations, and formulas for all cases: linear or nonlinear, phase difference or sum. This invention also provides the general calibration method for the case of distortion from the boundary conditions, or nonlinearity. Computer processing is based on these theories and formulas.

CALIBRATION and INITIALIZING (1)—The communication units, 381 in FIG. 3, 383 and 384 in FIG. 4, 387 and 388 in FIG. 5, are also called head locators as mentioned before. Usually there are two locators in the image reproduction and image recording system. The first locator together with the second locator is used for determining the head array position and direction, so that the position of each head in the head array can be determined by interpolation. For convenient in understanding the computer processing procedures of this invention, here we consider this situation first: using phase difference (rather than sum) and linear (rather than nonlinear) phase dependence, and for only one of the two locators. A schematic block of diagram with illustration is plotted in FIG. 19. The procedure starts with initialization, including calibration and initializing the status flag of the image pixels. First of all, check the status (is done or not) of calibration—911. If the calibration is not done, put the locator at (0,0), the center of the image area 10, and read out the voltage (or current) from the receiver for phase differences (PD) (between A2 and A1 in a CU pair, and between B2 and B1 in other CU pair)—912. Usually, at this point, the PD is not zero. The zero-PD calibration at (0,0) can be achieved either by hardware (phase shifter) adjustments, or by computer processing. FIG. 9 shows an example of phase shifter 431. By adjusting the phase shifter, the PD at (0,0) can be reduced to zero. If by computer processing, these two non-zero PD's will be stored for later use—913. Next put the locator at any corner of the image area and read out the PD—914. Procedure 915 calculates the PD changes and distance differences (DD) when the locator moves from the center to the corner. The first DD is defined as the distance difference of two CU's (such as A1–A2) in a CU pair from the head locator, i.e. $r_{A1}-r_{A2}$, and the second DD is defined as distance difference of two CU's (such as B1–B2)) in another CU pair from the head locator, i.e. $r_{B1}-r_{B2}$. Then the calibration coefficient is determined by the ratio of DD over the change of PD—916, which is the proportional coefficients between DD and the change of PD, and is used for converting the PD change to DD during the operation. The final step of initialization is to initialize flag of image status by setting all P(i)=0 (i denotes the i-th pixel)—917. The computer also figures out the scale transformation between the image area 10 and the image source stored in computer. According to the size of the image area 10, the computer will produce a frame on the computer screen according to the scale, and the operator can move the frame on the screen to the source area that he will most likely to reproduce. The status of any pixel outside the frame is initially set to 1. However, it is initially set to 0 if the pixel is inside the frame. For any pixel of which the corresponding image has been reproduced on the image area 10, the status P(i) will be changed to 1 from 0. If the status of a pixel is 1, the image of this pixel will not be reproduced again if head moves back to same place during the head arbitrarily moving. However, multiple reading from same pixel and overwriting the old reading doesn't matter.

CALIBRATION and INITIALIZING (2)—If calibration is done, then jump over the calibration block (the left dish-line frame) and wait for the commands (a trigger) for taking the phase information—920 that is sent from the phase processor, such as the one 430 in FIG. 9. By using the PD at (0,0) and the calibration coefficient, the two DD's are determined—921.

COMMON PROCEDURES OF COMPUTER PROCESSING (1)—Procedure 922 and hereafter are the common procedures for different cases: linear or nonlinear phase dependencies, using phase difference, or phase sum, or time difference. Procedure 922 is to solve the roots of an equation that includes the DD data, to outputs the locator position (x, y). The equation is different for the different cases listed at the beginning of this paragraph. Procedure 923 takes image information of the pixel that is the nearest to the head, from the stored image data 924. Then checks the status flag this pixel—925. If the pixel has been sprayed (P (i)=1), the next pixel is checked. If all the pixels have been sprayed (all P(i)=1), the job is down, and stop—926. If there is at least one pixel with status flag P (i)=0, then judge how close this pixel is to the head position (x, y)—927. If the distance is less than or equal to the criteria (1/20~1/5 pixel of error is preferred), then procedure 928 takes the color data of this pixel from the image file 924, and then sends the commands for spraying —929. Meanwhile, procedure 928 sets the status flag to 1 for this pixel. If the distance is greater than the criteria, then check the next pixel with status flag 0. If there is no such pixel that satisfies this condition at all, then system will wait for the next trigger for the next chance of meeting a pixel that is spray-able, during head arbitrarily moving—930.

COMMON PROCEDURES OF COMPUTER PROCESSING (2) As shown in the right dish-line frame, there are alternative procedures (932, 933, 934) for improving the efficiency. If there is no such a pixel at all, two fast-response actuators (not shown in Figures) are used to slightly adjust the position head. Procedure 933 finds the pixel in the image source which is the nearest to the head at the moment. The computer predicts how much the head array should be moved, by taking in the account the velocity and inertia of the head motion and the response time of the actuators-driven head, and then send commend to move and rotate the head array to right place —934.

Figure 20:
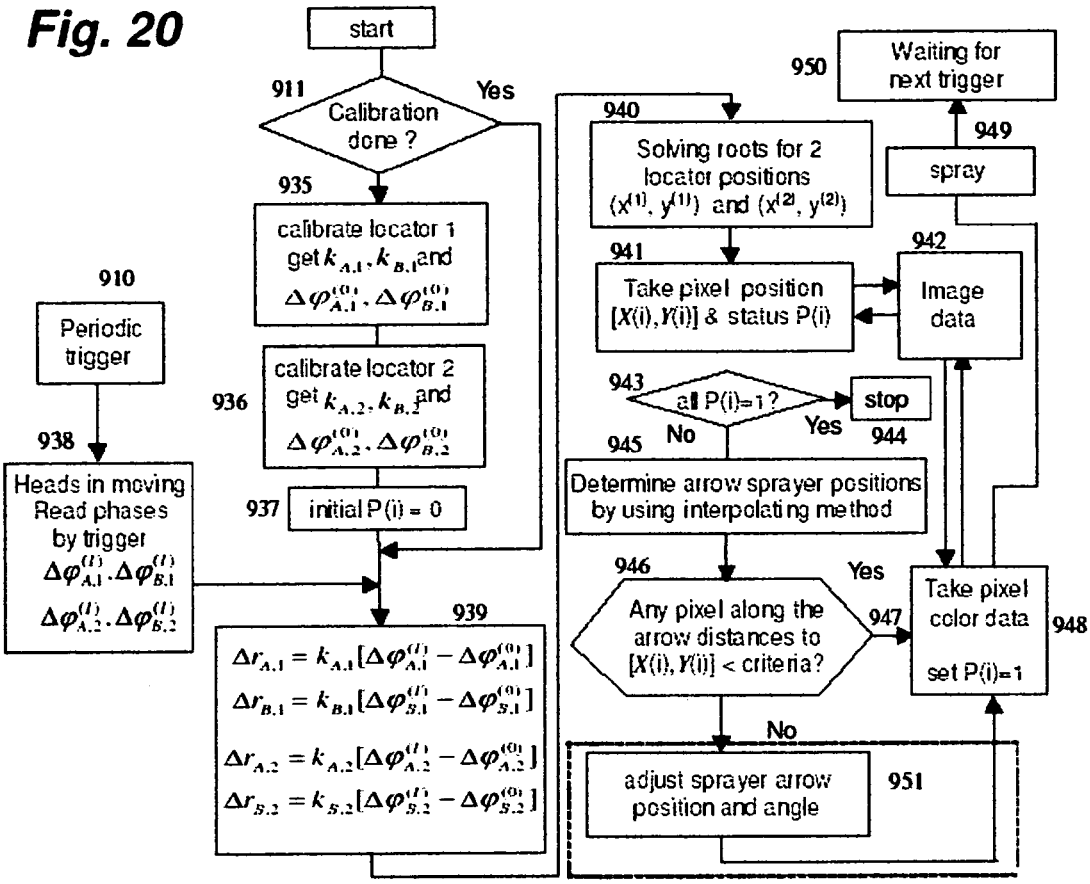
FIG. 20 is a flow chart of the position data processing and control for the head array.

POSITIONING OF EACH INDIVIDUAL HEAD IN ARRAY—For the case with two locators, the calibration described above is made for each of the two locators first —935 and 936 in FIG. 20. After the two pairs of calibration coefficients are obtained for the two locators, the status flag of each image pixel in the image source is initialized to 0—937. Now the computer takes the phase information from the two locators—938, then the two pairs of DD (distance differences) for the two locators are calculated by using the calibration coefficients—939. In the same way as described for the one-locator (single head) case above, the position coordinates of the two locators, $(x^{(1)}, y^{(1)})$ and $(x^{(2)}, y^{(2)})$, are obtained—940, and the status flag of each pixel is checked—941, 942, 943. If all the pixels have been sprayed/read (all P (i)=1), stop—944. Otherwise, the program uses interpolation method to determine the position coordinates of each head along the head array—946: $x(j)=x(j)=x^{(1)}+D_x\times(j-1)$, $y(j)=y^{(1)}+D_y\times(j-1)$, $D_x=(x^{(2)}-x^{(1)})/N$, $D_y=(y^{(2)}-y^{(1)})/N$. Here N is the total number of head along the head array, and j (=1, 2, . . . , N) denotes every head. Procedure 947 checks every head (i=1, 2, . . . , N) on the array—if the distance between any head and any pixel is less than the criteria? If yes, the computer takes the color data from that pixel and set status to 1—948, and then commands that head to spray or to read —949. Procedure 951 in the dish-line frame is an alternate for improving the efficiency, if there is no such pixel at all, or if there is only a few (too less) such pixels. In this case, three fast-response actuators are used to slightly adjust the head array position and direction, so that each head on the array can aim at a corresponding pixel. Two motors are installed at one end of the array [at the side of locator 383 (FIG. 4) or 387 (FIG. 5)] for controlling array position, and the third motor is installed at the other end of the array [at the side of locator 384 (FIG. 4), 388 (FIG. 5)] for controlling the array direction. The third motor drives the head array rotates about axle at the first head. Similar to procedure 933 in FIG. 19, the computer find out the pixel in image source which is the nearest to the position $(x^{(1)}, y^{(1)})$ of locator 1 or the first head at that moment (locator 1 or the first head has a corresponding relation, not necessarily physically the same). The computer predicts how much the array should be moved so that the first head aims at this pixel, by taking in the account the velocity and inertia of head motion and the response time of actuators-driven head, and then move the array so that the first sprayer aims at that pixel. Meanwhile, the computer predicts how much the array should be rotated to make each of the head in head array aim at a corresponding pixel, by taking in the account the moving trend and inertia. Then the actuator rotates the array by the predicted angle and computer commands the head to spray or to read.

INVERTING THE LOCATOR'S POSITIONS BY SOLVING EQUATIONS—For the modulation-based method, the phase has a linear dependence on the distance (r) between the receiver and the transmitter. For the given two pairs of detected phase difference ($\Delta\phi_A$=phase of A2−phase of A1, and $\Delta\phi_B$=phase of B2−phase of B1), or phase sum ($\Sigma\phi_A$ and $\Sigma\phi_B$), the position coordinates (x, y) of the locator are the roots of the equations $$(x\cos\theta_1 + y\sin\theta_1)^2/a_1^2 - (-x\sin\theta_1 + y\cos\theta_1)^2/b_1^2 = 1 \text{ and } -(x\cos\theta_2 + y\sin\theta_2)^2/b_2^2 + (-x\sin\theta_2 + y\cos\theta_2)^2/a_2^2 = 1, \quad \text{with } b_i = \sqrt{c_i^2 - a_i^2}.$$

When A1, A2, B1, B2 are at the corners, $\theta_1$, is the angle between the line A1-A2 and the right direction of the horizontal line and $\theta_2=90-\theta_1$. However, when A1, A2, B1, B2 are at the middle edges, $\theta_1=0$ and $\theta_2=0$. For the phase difference approach, $c_1=D_{A2\text{-}A1}$ (distance between A1 and A2, same meaning hereafter), $c_2=D_{B2\text{-}B1}$, $a_1=c_1-k_A\Delta\phi_A$, $a_2=c_2-k_B\Delta\phi_B$. For the phase sum approach, $c_1=0.5D_{A2\text{-}A1}$, $c_2=0.5D_{B2\text{-}B1}$, $a_1=0.5k_A\Sigma\phi_A$, $a_2=0.5k_B\Sigma\phi_B$. For the phase difference approach, $b_i$ is a pure real number, and the contour curves for constant phase differences are a class of hyperbola curves, and the right root-pair (x, y) is uniquely distinguished from the four pairs of the roots by checking the signs of the two phase-differences. Here is an example: consider the case A1–A2 is vertical to B1–B2, as the cases shown in FIGS. 2(*b*) and (*c*). The phase information ($\Delta\phi_A<0$ and $\Delta\phi_B<0$) corresponds to the solution with (x>0, y>0); ($\Delta\phi_A<0$ and $\Delta\phi_B>0$)⟷(x>0, y<0); ($\Delta\phi_A>0$ and $\Delta\phi_B<0$)⟷(x<0, y>0); and ($\Delta\phi_A>0$ and $\Delta\phi_B>0$)⟷(x<0, y<0). While, for the phase sum approach, $b_i$ is a pure imaginary number, and the contour curves for constant phase sum are a class of ellipse curves, and the right root-pair (x, y) cannot be distinguished from the four pairs of the roots by using the phase information. In this case, the computer program sets the region ID (identification) for the four quarter-regions (left bottom=1, right bottom=2, left top=3, right top=4). The operator inputs the locator region ID from a keyboard when the locator begins to move. The computer then changes the region ID whenever the locator moves across the region boundaries. Therefore, the right root-pair (x, y) is distinguished from the region ID and the moving trend.

INVERTING THE LOCATOR'S POSITIONS BY SURFACE FITTING—The above procedures for modulation-based method are characterized by the linear dependencies of the phase. However, for the direct-RF system, radio frequency (RF) is directly (i.e. not used as modulation) used as the information carrier. The phase has a nonlinear dependence on distance (r) between the receiver and the transmitter due to the near field: $\phi(r)=kr-\tan^{-1}[(k^2r^2-1)/(kr)]$, k is propagation constant of RF wave. The coordinates of locator can be determined by finding the minimum point of $I(x, y)=[\phi(r_{A2})-\phi(r_{A1})-\Delta\phi_A]^2+[\phi(r_{B2})-\phi(r_{B1})-\Delta\phi_B]^2$, or $I(x, y)=[\phi(r_{A2})+\phi(r_{A1})-\Sigma\phi_A]^2+[\phi(r_{B2})+\phi(r_{B1})-\Sigma\phi_B]^2$. Here ($\Delta\phi_A$ and $\Delta\phi_B$), or ($\Sigma\phi_A$ and $\Sigma\phi_B$), are the detected phase differences, or phase sums, respectively. The minimization for first step starts at the initial point that is defined by the roots of the linear equations from the linear limit (the larger r) of the phase dependence, and the minimization for later steps starts at the previous position of the locator. The boundary condition of the electromagnetic filed may introduce a discrepancy of the phase dependence used in the formula above, which is determined by the environment and cannot be predicted ahead. If the discrepancy is significant, a calibration method is employed. The calibration method is to mesh the image area 10. Move the locator at each node on the mesh. The computer then records the phase difference and the coordinates of the node. Then the computer uses the surface functions to fit the coordinates versus the phase difference by using numerical methods (such as finite element method). By using these surface functions, the computer determines the coordinates from the phase difference when the locator moves to any position on the image area 10.

PHASE-CURRENT PROCESSING (1)—For both cases of using digital phase detector (DPD) and mixer, the phase shifters built in the operation units are so adjusted that, for the zero phase (i.e. phase difference between two inputs of the DPD, or mixer), the output current is zero. The DPD outputs a linear current that is proportional to the phase (i.e. phase difference between the two inputs of the DPD) in the region ($-2\pi$, $2\pi$). However, the curve is wrapped out of this region for every $2\pi$ of increase or decrease in phase, as shown in bottom of FIG. 21. The mixer outputs a current that is proportional to the sine function of the phase. So the monotonous region is ($-\pi/2,\pi/2$). Out of this monotonous region, there are the other monotonous regions for every $\pi$ increase or decrease in phase. So usually, if the noise level is low enough, only the middle region is used for both cases. Therefore, the wavelength of the RF modulation or RF-carrier should be the maximum dimension of the image area 10 if DPD is used, or should be 4 times of the maximum dimension of the image area 10 if mixer is used. So, using DPD contrast using mixer, signal to noise ratio (SNR) is 4 times better under same noise level, that means, the resolution is 4 times better. The minimum (or best resolution) is determined by the noise level.

Figure 21:
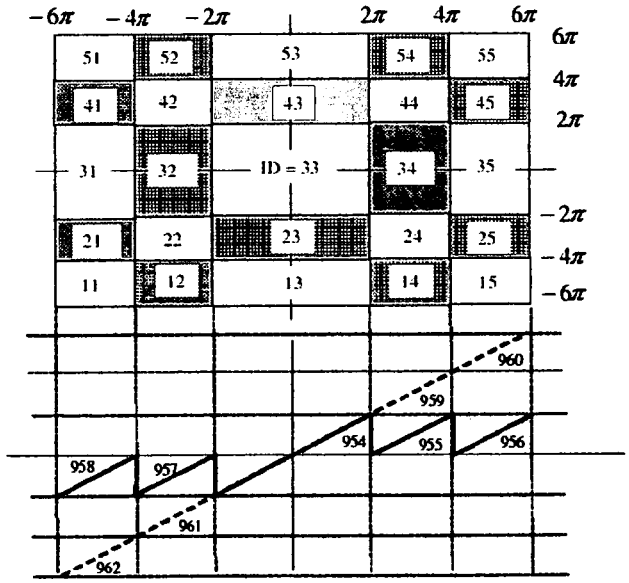
FIG. 21 is a schematic chart of the wrapping of current-phase-relation of in a digital phase detector (DPD) and the wrapped region in the 2-D phase space.

PHASE-CURRENT PROCESSING (2)—For higher resolution applications (i.e. using multi-level RF), if the noise level cannot be reduced, the current-phase unwrapping (for each level) needs special treatment. For the case of using sin DPD, as shown in the top of FIG. 21, the phase space is divided into $(2M-1)^2$ regions, with M=3 as an example. This leads to M times better resolution. Each region is assigned to an identification (ID) number (ij) (i, j=1, 2, . . . , 2M−1), (i=1, 2, . . . ) denotes the number of wrapped regions for the phase difference between B1 and B2, and (j=1, 2, . . . ) denotes the number of wrapped regions for the phase difference between A1 and A2. The computer's program always changes the ID number if the locator moves across the boundary and into a new region. Therefore, before locator starts moving at center region, the computer initializes ID at the center region, that is, set ID=33, for the case as shown in FIG. 21. Then the locator is moved to the position where the operator wants to start the work, and the computer follows the regions that the locator passes and promptly changes the ID numbers. Finally, for example, the locator moves to the region 51 through a path, and the computer follows the locator and finally changes the ID number to 51 starting from 33. Let's distinguish phase-current and detected-phase-current. The detected-phase-current is the output of the DPD (the solid lines in bottom of FIG. 21). Unlike detected-phase-current, the phase-current is the processed current after unwrapping and is scaled to phase (the dish lines in bottom of FIG. 21), and the phase is the phase-difference used in the next computer processing as described above. For the non-center region, the phase-current should jump a value from the detected-phase-current. As shown in FIG. 21, for regions 34 and 35, the phase-current for phase difference of A2–A1 should shift to 959 and 960, respectively, from the detected-phase-current (955 and 956). Or, in other words, in the regions 34 and 35, the unwrapped phase is determined from phase-current, and the latter is obtained from detected-phase-current by adding $2\pi$ and $4\pi$, respectively. The phase unwrapping process of current level is monitored by it's lower level. If using a very large M, this method can also serve as an alternate for relative-motion-based system that will be described later.

PHASE-CURRENT PROCESSING (3)—For the case of using the mixer, the procedures are almost the same as DPD, except the region size (all $\pi\times\pi$, rather than $2\pi\times2\pi$, $2\pi\times4\pi$, $4\pi\times2\pi$, and $4\pi\times4\pi$ in the DPD case) and the sine dependence of the detected-phase-current on the phase (rather than linear dependence). Therefore, the detected-phase $\Delta\phi_d$ is determined by inverting the sine function from the detected-phase-current. The phase is transformed from $\Delta\phi_d$, such as $\pi-\Delta\phi_d$ and $2\pi+\Delta\phi_d$ for the first right region and the second right region from the center region, respectively, for example.

COMPUTER PROCESSING OF TIME-BASED METHOD—For the time-based method (i.e., based on the time measurement), the computer receives two time differences, $t_{A1}$ and $t_{A2}$ from the OU 400, which are the times for the pulse propagation from the CU at A1 and A2, as shown in FIG. 2(*d*), to the CU as head locator. Then the computer solves the root pair (x, y) from the equations $(x-x^{A1})^2+(y-y_{A1})^2=(t_{A1}v)^2$ and $(x-x_{A2})^2+(y-y_{A2})^2=(t_{A2}v)^2$. Here v is the speed of the pulse propagation. If the origin of coordinate system is defined at the middle of bottom edge, so that $y_{A1}=0$, $y_{A2}=0$, and at the vertical central-line of the image area 10, x=0, then the two pairs of roots with negative root of y coordinates are dropped. The positive root of y is used and negative sign for x is used if $t_{A1}<t_{A2}$, and positive sign for x is used if $t_{A1}>t_{A2}$.

Figure 22:
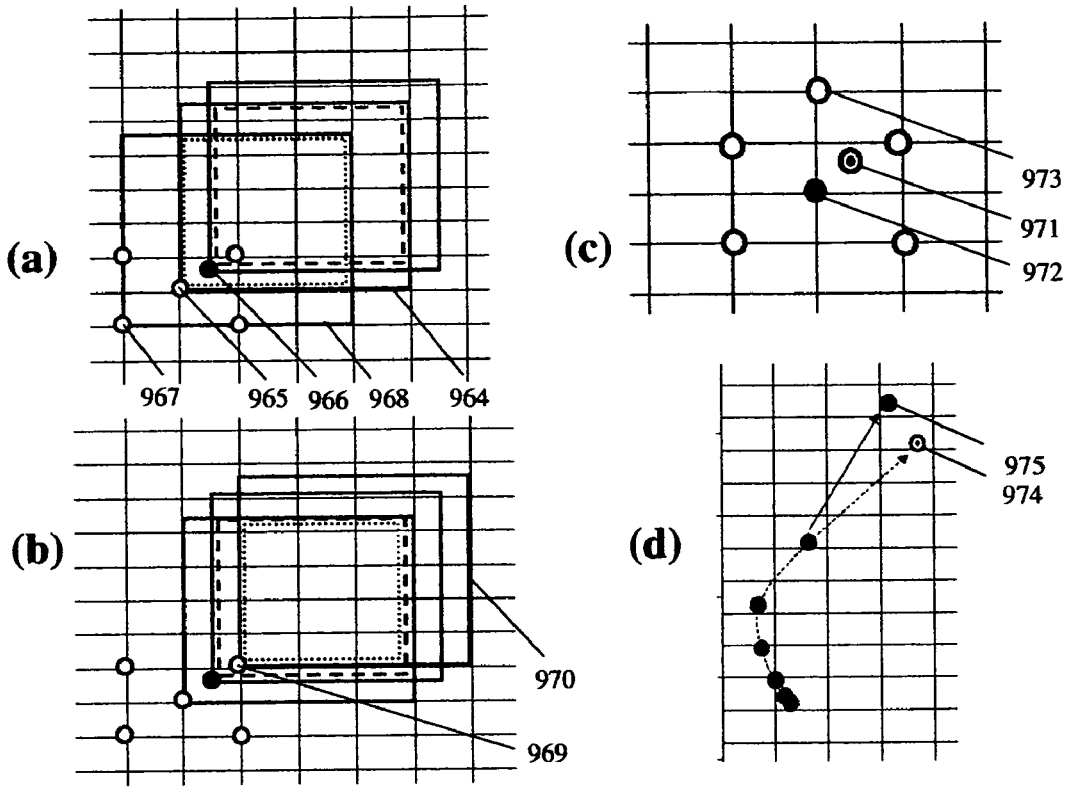
FIG. 22 is a schematic chart of data correlation processing for relative-motion-based system: image correlation conception and simple motion.

COMPUTER PROCESSING OF OPTICAL IMAGE-MOTION-DETECTOR BASED APPROACH—For the relative-motion-based method, the head includes a motion detector (MD) and operation module (OM). The preferred apparatus for the MD is the optical image-motion-detector (340), as shown in FIG. 8. The camera pixel sensor array 346 converts the optical image into electrical signals, which are sent to the computer's memory for digital processing. The head starts moving at the center of the image area 10 after the initial setting of the reference point of the relative motion at this point. At this moment, a picture is taken—the middle panel that are shown in FIG. 22 (*a*) represents the windows of image 964. The position of the image 965 is defined as the left bottom corner of the window. At this moment, the image position is at 964. At the moment of the next trigger, the head is moving to the position 966 marked by the filled circle. The picture-taken frequency should be high enough so that between the two neighboring pictures, the position of locator just changes a distance of a few pixels, even if with the fastest moving. Especially, if the head starts from static state, the position just changes a distance within one pixel. The computer starts the minimization of image-correlation at assumed positions, one of the positions is at 967 for example. The image-correlation is defined as the averaged summation (i.e. integral) of squares of difference (or absolute value of difference) of light intensity at pixels over the common image area (thin dash line) of the two pictures. One of pictures is the previous picture 964, the other is preset picture 968 but at assumed position 967. So if the image-correlation is smaller, the assumed position is closer to the actual position 966. From FIGS. 22 (*a*) and (*b*), the image-correlation for position 967 (FIG. 22 (*a*)) is larger than that for position 969 (FIG. 22(*b*)). The minimization of image-correlation leads to the maximization of convolution of two pictures, for the latter FFT can be applied. However, for small CCD pixel number, FFT has no benefit, so the following method will be used.

HEAD SPEED UP MOTION—For the cases that the head starts moving or restarts to move after the speed is reduces to zero, the computer will determine the relative position of this picture 971 to the previous picture 972 in FIG. 22 (*c*). However, the computer does not know along which direction the head is moving. The computer calculates the image-correlation at five points (i.e. five assumed positions) and then uses a surface to fit five points of the correlation. Computer finds out the maximum point on the surface (or the minimum point of the 'negative surface'), which is (or very close to) the actual position 971 of the image at the present moment. Among the five points, one point is called the surface-fitting center 972, which is, at this moment, at the previous position. The other four points are at the four nearest corners (open circles in (c)) of the surface-fitting center. Hereafter, the term "frame" represents the quadrilateral frame, of which the four corners are at the four outer points with the center at the surface-fitting center, for five-point fitting. And it represents the pentagonal frame, of which the five corners are at the five outer points with the center at the surface-fitting center, for six-point fitting below. It would be lucky if the maximum correlation point is inside the frame (as shown in (c)). If the maximum point is inside the frame but too close to the boundary, one more point 973 on the lower side of the surface is needed, and computer redoes the surface fitting by six points, for better accuracy. For each new position at a new trigger moment, the first surface fitting is made by always using five points. The second-and-after surface fitting are made by always using six points.

HEAD SIMPLE MOTION—If the head is moving, the computer stores the history data of the head positions. From these data, the head movement trend (the velocity and acceleration) can be determined. Therefore, the position of next picture at the next triggered moment can be predicted at 974 (by extrapolation), as shown in FIG. 22(*d*), although the actual position is at 975. Then the computer finds the nearest pixel to the predicted position 974, and uses this pixel as the surface-fitting center, and repeats the procedures described in the above section (with FIG. 22(*c*)). If the prediction is accurate enough (i.e. head motion is not complex), the actual position (that is the maximum point) of the picture at this moment should be inside the frame. So the same later procedures described in the above section (with FIG. 22(*c*)) are applied. Otherwise, the computer should finish the following procedures.

Figure 23:
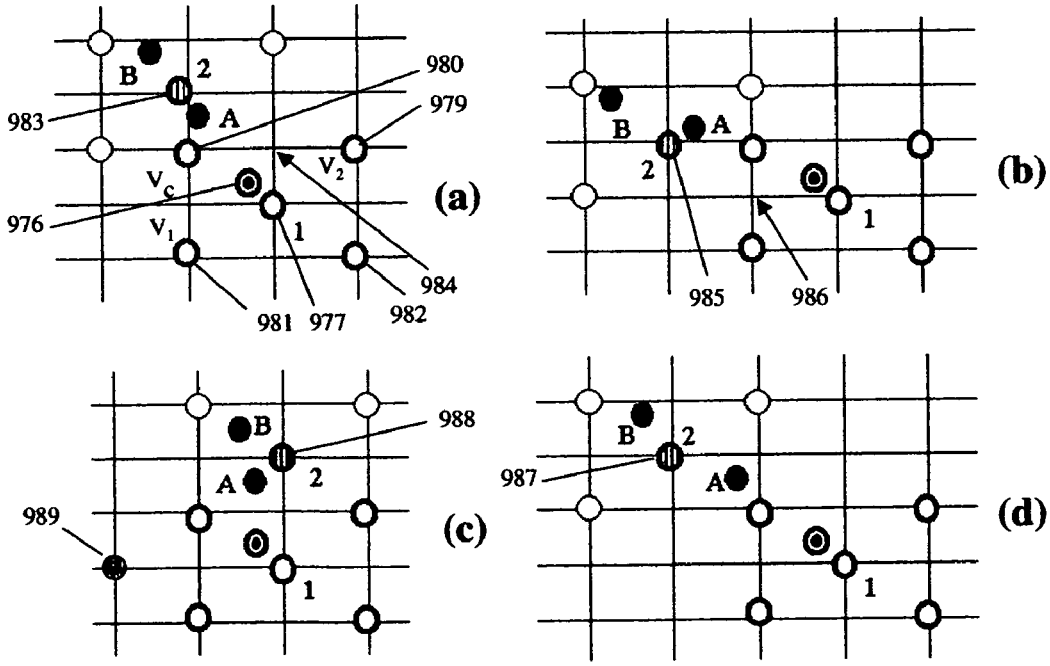
FIG. 23 is a schematic chart of data correlation processing for relative-motion-based system: complex motion.

HEAD COMPLEX MOTION—The extrapolation-predictable motion is called simple motion, otherwise it is called complex motion. If head complex motion, the prediction is not efficient. Therefore, as shown in FIG. 23, the actual position (may at A or B) of the picture at this moment is out off the frame of which the center (surface-fitting center) is at 977. The center 977 is the closest pixel to the predicted position 976. This means that there is no maximum point in the frame center at 977. Therefore need re-setting surface-fitting center the computer needs to compare the values of the correlation at the four corners, and picks out the point with lowest correlation value, $V_c$ (i.e. the point 980 for the case shown in FIG. 23(*a*)), and picks up the values of the two neighbored corners, $V_1$ for 979 and $V_2$ for 981. Then the computer defines the two variables: $R_1=\min\{|V_1-V_c|/V_c,|V_2-V_c|/V_c\}$ and $R_2=|V_1-V_2/V_c$, and sets the two criteria's $CR_1$ (say 0.5) and $CR_2$ (say 0.2) which need optimization. Here min{ } means taking the minimum value in the list. If $R_1>RC_1$, $R_2>RC_2$ and $V_1<V_2$, then use 983 (in FIG. 23 (*a*)) as the next surface-fitting center. If $R_1>RC_1$, $R_2>RC_2$ and $V_1>V_2$, then use 985 (in FIG. 23 (*b*)) as the next surface-fitting center. If $R_1>RC_1$, $R_2\leqq RC_2$, then use 987 (in FIG. 23 (*d*)) as the next surface-fitting center. If $R_1\leqq RC_1$ and $V_1<V_2$, then use 988 (in FIG. 23 (*c*)) as the next surface-fitting center. If $R_1\leqq RC_1$ and $V_1>V_2$, then use 989 (in FIG. 23 (*c*)) as the next surface-fitting center. This time, we don't need four points, but three or two points (thin open circles) around the new surface-fitting center will be added. The surface-fitting is carried out by six (rather than five) points, the center and the newly added points plus some old points. If using the old points [980 and 979 for the case in (a), 980 and 981 for the case in (b), 977, 980,979 for the case in (c), and 980, 979 or 981 for the case in (d)], the point 984 in (a) or 986 in (b) is not necessary. If a maximum point is found in the new frame, the actual position of the head at the present moment is obtained. Otherwise, the computer repeats the procedures until the actual position is found.

DOPPLER EFFECT METHOD—The Doppler effect of wave is used for positioning. Here use ultrasonic wave as an example. For the system based on ultrasonic Doppler effect, the generators 488, 489 in FIG. 17 generate the oscillation current with two frequencies that are fair away from each other, and the transmitters 281, 282 in FIG. 17 radiate continuous ultrasonic waves. Receiver 381 is replaced by a Doppler frequency detector. When the receiver 381 is moving around in the two ultrasonic fields, the Doppler frequencies are detected. Computer converts the two Doppler frequencies into the velocities ($v_1$ and $v_2$) that face to the two wave sources, respectively. Then the displacement of the head facing the two sources can be obtained by integrations $$\Delta r_1 = \int_0^{\Delta T} v_1\, dt \text{ and } \Delta r_2 = \int_0^{\Delta T} v_2\, dt\ ,$$

respectively. Here ΔT is the time interval of the two neighboring triggers. If the head positions relative to the two sources at the moment of the latest previous trigger are $\vec{r}_{10}$ and $\vec{r}_{20}$, respectively, the head displacement is $$\Delta\vec{r} = \Delta r_1 \frac{\Delta\vec{r}_{10}}{r_{10}} + \Delta r_2 \frac{\Delta\vec{r}_{20}}{r_{20}}.$$

Then the head positions relative to the two sources at the moment of present trigger can be written as $\vec{r}_1 = \vec{r}_{10} + \Delta\vec{r}$ and $\vec{r}_2 = \vec{r}_{20} + \Delta\vec{r}$, respectively. Now the computer solves the root pair (x, y) from equations $(x-x_{A1})^2+(y-y_{A1})^2=r_1^2$ and $(x-x_{A2})+(y-y_{A2})^2=r_2^2$. The next procedures are same as that in the time-based system described above.

JUMP HAPPENS—In relative motion method, if a jump happens to the head carrier during its moving on the image surface due to some reason, the head needs to be put back to the nearest reference point that are previously set during the process, the most important reference point among the reference points is the center of the image area 10.

RECORDING SYSTEM—For the recording system, the constitutions and procedures are the same, except that the sprayer array would be replaced the by reader array.

What is claimed is:

1. A method to generate image for use with plurality of applications using a flexible and mechanical-guiding-apparatus-free operation method for image reproduction and image recording, the method comprising:

providing a mechanical-guiding-apparatus-free operations for head freely motion in the image space, a preferred apparatus is called head carrier with any predetermined constitution, structure, size, and shape, performing the action of image generation by using head array, providing head positioning by using any predetermined positioning method and interpolating and extrapolating head position along said head array from positions of head locators if head array has more than one head, providing system operation by using an executive unit, providing computer processing for positioning, system operation and embodiment control, with at least a programmable device that is generalized computer, hereafter shortly computer, wherein the flexible and mechanical-guiding-apparatus-free operation method for image reproduction comprising:

reproducing image in image space based on image data stored in the computer, by arbitrarily moving said head carrier, in the image space, said executive unit executing the positioning operation of the head locator by using positioning method to get the positioning data of the head locator, the computer processing the positioning data of locators from said executive unit and obtaining the position of locators and then determining the coordinates of each head in said head array by using interpolation and extrapolation method, according to the coordinates of each head, and in the pixel grids of image data file stored in a disk and taking the color data and flag of this pixel, the computer searching for the pixel that satisfies the criteria for executing action of reproducing, and sending the data including commend data to said executive unit; said executive unit passing data and sending power to the head to execute the actions of spraying, printing, or deposition;

said computer then records the history of the image reproducing process by changes the flag of this pixel to avoid the pixel be reproduced again if the head moves back to the same position later, wherein the flexible and mechanical-guiding-apparatus-free operation method for image recording comprising:

head taking the image digital data from image space during its arbitrarily moving in the image space;

trigged by a trigger, the coordinate information and color data are taken from the image space at the triggered moment and are sent back to computer;

at triggered moment, said executive unit executing the positioning operation of the head locator by using positioning method to get the positioning data of head locator;

at triggered moment, the computer processing the positioning data of locators from said executive unit and obtaining the position of locators and then determining the coordinates of each head in said head array by using interpolation and extrapolation method;

at triggered moment, said executive unit passing command data and sending power to the head to execute the actions of reading, base on the criteria for executing action of recording, said computer processing the position and color information promptly or storing color data and position data into a file for processing later, said computer then records the history of the image recording process by changes the flag of the close pixel to see which area is not reading yet, then said computer calculating the color values at all pixels on pre-formatted pixel grids based on the obtained coordinates and color data, by using interpolation and extrapolation method, in case that the head at the triggered moment is not exactly at a pixel in the pre-formatted pixel grids;

whereby, if applied, the phase-does-matter signals being transmitted by cable with controlled-length, the phase-doesn't-matter signals and the information of the image and the control commands being transmitted through wires or cables, or equivalently through any kind wireless, whereby, by using said image generation method, one can reproduce or record images and patterns on or from any flat or curved surface and image space, such as applied for generating patterns on building wall or cliff, golf course, basketball courts, football/soccer fields, billboards, posters, portraits and paintings, industry applications, design blueprints, industry decorations, decoration arts, family multi-function printer, family painting and wall decorations, archaeological imaged pattern taking, museum image/pattern backup and sculptures.

2. The method of claim 1, wherein a preferred head carrier comprising:

main body of the head carrier with a predetermined constitution, structure and shape, whereby, the equivalences include hand-hold brush-like, head holder with feasibility for holding said head array, at least one wheel, driven by hand or robot or carried by vehicle, enabling the head carrier moving in the image space freely, at least one head locator for positioning, at least one of the following being built on the head carrier for convenient or performance improvement when necessary:

a hand stick, for providing freely hand-operation, and for flexible application in plurality of situations, a container for storing the deposition materials, wherein, said container being built on the head carrier for smaller applications or being put on the ground for large applications, a powered actuators being installed on said head holder for micro adjusting the position and direction of said head array for operation efficiency.

3. The method of claim 1, wherein said head array comprising at least one head, being installed on said head carrier, for depositing or printing or spraying pattern on and/or reading pattern from image surface.

4. The method of claim 1, wherein the step of providing system operation by using said executive unit comprising:

detecting position of said head locator;

generating, transmitting and receiving signal, if needed;

exchanging and passing data;

passing commands;

providing power and embodiment control;

whereby, the executive unit is determined by positioning method used, and so could be any embodiment with the functions mentioned above, such as operation unit for wave-based method of head locator positioning, or operation module for relative-motion-based method of the head locator positioning.

5. The method of claim 1, wherein the step of providing computer processing, system operation and embodiment controlling comprising:

determining position of each locator by using distance information from said executive unit, determining all coordinates of the individual heads in the head array by using interpolation and extrapolation if array contains more than one head from positions of locators, according to pixel grids, finding out the pixels that satisfies the criteria for executing action including finding out the pixels closest to the corresponding heads in the head array and checking the status flag of these pixels then deciding to execute or not the action of image generation, base on:

if the action for current pixel has been executed, with status flag=1, the next pixel is checked;

if the action for all pixels have been executed, with all status flag=1, the job is finished, and stop;

if there is at least one pixel with status flag=0, then judge how close to the head it is;

if the distance is less than or equal to the criteria, taking the color data of current pixel from the image file for reproducing or reading color data from image space for recording, and then sending the command to execute the action, meanwhile changing the status flag to 1 for this pixel;

if the distance is greater than the criteria, then check the next pixel with status flag=0;

if there is no such pixel that satisfies this condition at all, then program will wait for the next trigger for the next chance of meeting a pixel that needs the action, during head arbitrarily moving;

if there is too less or no such a pixel at all, three fast-response actuators starting their work to slightly adjust the position and direction of head array for improving the efficiency.

6. The method of claim 1, wherein said predetermined positioning method comprising step of positioning for at least one head locator, which include one of the methods of wheel-based techniques, inertial-based techniques, existing computer mouse techniques, wave-based method and relative-motion-based method.

7. The method of claim 6, wherein the wave-based method comprising steps of:

providing communication units for transmitting and receiving signals during positioning operation, being used for positioning, and being placed at the predetermined positions, wherein the signal being a predetermined kind of waves;

providing operation units for supplying power, generating signals, processing signal, passing the information of position and passing control commands;

providing at least one of the communication units being served as a locator for positioning, wherein the computer inverts coordinates of locator position from information of waves which includes phase information and distance information;

providing system operation procedures for computer programming, embodiment controlling, signal processing and locator positioning.

8. The method of claim 7, wherein one kind of said communication unit, called wave transmitter, being used for transmitting waves, whereby, according to individual case, said wave transmitter is one of radio frequency antenna, shorter microwave antenna being modulated by radio frequency, ultrasonic transmitter, and fight transmitter being modulated by radio frequency.

9. The method of claim 7, wherein one kind of said communication unit, called wave detector or wave receiver, being used for receiving waves, whereby, according to individual case, said wave detector is one of radio frequency antenna, short microwave antenna with radio frequency signal being demodulated from the carrier wave by either heterodyne or homodyne in the detection, ultrasonic receiver, and photon-detector with radio frequency signal being demodulated from the carrier wave by either heterodyne or homodyne in the detection.

10. The method of claim 7, wherein the positions of transmitter and receiver being swappable includes the communication units for receiving being installed with locator and the communication units for transmitting being installed at edges of field, or swapped, the communication units for receiving being installed at edges of field and the communication units for transmitting being installed with locator.

11. The method of claim 7, wherein the step of positioning based on detecting phase information of the radio frequency waves with at least one pair of frequencies for at least one locator, comprising:

providing communication unit for transmitting carrier wave and receiving carrier wave on which the information carrier being carried, wherein information carrier is ridding on carrier wave;

providing operation unit executing the operations of obtaining and outputting phase information, including generating information carrier and carrier wave, modulating carrier wave by information carrier, demodulating information carrier from detected carrier wave, phase detector detecting at least one group of phase information from information carrier, and outputting phase information;

computer receiving at least one group of phase-current of phase information correspondingly from at least one pair of information carrier for positioning of locator;

computer converting said phase information into distance information, with phase unwrapping if needed, then obtaining the coordinates of the position of each locator from said distance information;

wherein, number of frequency pairs depending on the dimension in application, wherein, information carriers including a radio frequencies, are implemented in at least one level, in at least one band of radio frequency, each band if more than one is sufficiently separated and thus has sufficiently separation in scales for positioning;

wherein, riding on the carrier waves means the carrier waves are modulated by information carriers of much higher frequency or light wave is modulated by lower radio frequency, through either amplitude modulation or frequency modulation, in form of coherent or incoherent, whereby, in the case needed, said radio frequency is directly used as the carrier wave for positioning information, or, is used as information carrier through riding on the carrier waves.

12. The method of claim 11, wherein the step of providing said operation unit comprising:

providing an information carrier block to generate and transmit desired radio frequency signals, providing a carrier wave block, when information carrier needs to be carried, to generate and transmit the desired carrier waves, with a radio frequency modulator, providing a signal receiving and processing block to receive and process all signals, cooperating with computer for executing system operation, including data exchange and conducting positioning information, embedded control commands.

13. The method of claim 11, wherein said phase detector is digital phase detector for detecting phase difference of two inputted signals, or, is mixer using homodyne or heterodyne, for detecting phase difference or phase summation of two inputted signals.

14. The method of claim 11, wherein the step of obtaining phase information, by directly using radio frequency as carrier wave, for each of locators and for each level of radio frequency, comprising:

providing noise detector for searching the channels of radio frequency with the lowest noise;

oscillators being tuned to low noise channels of radio frequency, at least one pair of radio frequencies being generated and being sent to at least one pair of transmitting antennas;

providing a receiver for receiving signals from the transmitters;

after the band pass amplifier, signals being split by at least one pair of splitters;

corresponding pair of band pass filters allowing only one frequency pass through each one of filters in said pair;

phase processor decoding corresponding pair of phase information, wherein, said phase information is either phase difference or phase summation;

after phase calibration, phase information being sent to computer, wherein said calibration is done by the software in computer or by phase calibrator before signal goes into computer whichever it is preferred.

15. The method of claim 14, wherein the phase processing of processor comprising:

two frequencies being inputted to any one pair of two pairs of inputs, which produce another two frequencies, sum frequency and difference frequency, and the same is applied to the other pair;

band pass filter for filtering out difference frequency or sum frequency, and selects either the difference frequency or the sum frequency for processing, and then information of phase difference or phase sum is decoded by phase detector.

16. The method of claim 11, wherein the step of obtaining phase information, by using radio frequency as information carrier riding on carrier-wave, for each of locators and each level of radio frequency, comprising:

providing at least one pair radio frequency being generated by the radio frequency oscillators and being amplified, and resulting in at least one path of radio frequency;

providing a splitter for splitting certain radio frequency into multiple paths, if number of paths of radio frequency is less than number of carrier-wave sources;

driver of carrier-wave providing at least one pair of currents to at least one pair of sources of carrier-wave to emit radiations with at least one pair of wavelengths of carrier wave;

each path of radio frequency being conducted to each of carrier-wave sources, respectively;

each carrier-wave being modulated by corresponding radio frequency before emitting, wherein, said modulation is either amplitude or frequency modulation, and said carrier-wave is either coherent or incoherent;

corresponding pair of receiver include photon detector in most cases, receiving radiations and converting the power into radio frequency currents, wherein, each pair of detectors has a pair of optical filers, and each optical filer in said pair allows only one corresponding wavelength in said pair of wavelengths to pass through;

detected currents of radio frequency being sent to radio frequency band pass filters;

phase information being decoded by phase detector, wherein said phase information is either phase difference or phase summation;

phase information of the information carrier being sent to computer.

17. The method of claim 11, wherein the phase-current processing and phase unwrapping comprising:

adjusting the phase shifters so that phase detector has zero output when the difference of inputted phases is zero;

for higher resolution applications, the current-phase unwrapping in each radio frequency level is specially treated by assigning a region identification number for locator position status;

before head starts moving at center region, the computer initializes the identification number of the center region to locator position status;

computer promptly changes the identification number when locator is across the region boundary, and the phase-current should jump a value from the detected-phase-current, wherein, if mixer is used, detected-phase is determined by inverting the sine function from the detected-phase-current.

18. The method of claim 11, wherein the step of computer signal processing and positioning for each locator, comprising:

calibrating system, initializing system status;

determining calibration coefficient, and finding out scale of transformation;

determining phase information of phase differences or phase sum;

determining distance information by using phase information and calibrated coefficients, wherein, distance information is either distance difference or distance sum;

wherein, distance difference is determined correspondingly from phase difference and distance sum is determined correspondingly from phase sum.

19. The method of claim 7, wherein the step of positioning based on detecting time difference of the pulses arriving, comprising:

providing communication unit for transmitting pulse wave, and receiving pulse wave;

providing operation unit for executing the operations of obtaining and outputting time difference, including generating pulse waves, detecting at least one group of time difference from received pulses, and outputting time difference;

computer receiving time difference correspondingly from operation unit for the corresponding locator;

computer inverting the coordinates of the position of each locator from time difference by solving root equations;

whereby, in the case needed, said pulse is one of ultrasonic wave pulse and electromagnetic wave pulse.

20. The method of claim 19, wherein the step of providing said operation unit comprising:

providing a pulse wave generation and transmitting block, comprising pulse clock, time counting clocks, pulse wave generator, amplifier;

providing a pulse wave receiving and processing block, comprising amplifiers, narrow band-filters, triggers, time counting clocks, and time counters;

cooperating with computer for executing system operation, including data exchange and conducting positioning information, embedded control commands.

21. The method of claim 19, wherein obtaining time difference comprising:

pulse wave is generated by transmitter; in the meantime, a signal is send out to start time-counting at the moment the pulse is sent out;

pulse wave is received by receivers, the signal is amplified and is sent to triggers to stop the time-counting;

time counters send the time differences to computer;

frequency filters are used to distinguish the two pulses from the two transmitters or locators.

22. The method of claim 6, the relative-motion-based method comprising steps of:

providing a motion detectors, together with the head array, being installed on head holder for obtaining the information of locator's relative motion;

providing an operation module;

at least one of the motion detectors being served as locator for positioning, wherein the computer obtaining coordinates of position from relative motion information;

providing a system operation procedures for computer programming, embodiment controlling, signal processing and locator positioning;

providing a procedures for locator re-tracking and tracking continuity when jump happens to locator.

23. The method of claim 22, wherein the step of providing said operation module, comprising:

providing a section for supplying power, generating signals, providing a section for processing signal of motion information, providing a section for passing the information of position and passing control commands;

cooperating with computer for executing system operation, including data exchange and conducting positioning information, embedded control commands.

24. The method of claim 22, wherein the step of detect image motion by using optical image-motion-detector, comprising:

providing one light source, for providing the light for detector to see the micro texture of patterns, roughness, texture, etc, in the image space along the path of the head locator;

providing first lens, for converting the light into collimation beams and illuminating onto the surface of the path of head locator;

providing second lens, to make the optical image of the micro texture onto the surface of the sensor array;

providing a photon sensor array including at least one photon sensor, for taking the picture of the micro texture along the path of the head locator during head motion and sending the pictures to computer through the operation module for data processing and head positioning by using, the method of image-correlation.

25. The method of claim 22, wherein the step of computer processing and control for optical image-motion detection comprising:

initially setting reference points of the relative motion;

hereafter, for every trigger moment, picture being taken for image-correlation; the picture-taken frequency being high enough, so that the position is not changing and thus the neighboring two images have enough overlap area;

relative moving distance of locator being obtained from minimization of image-correlation; wherein, image-correlation is defined as the averaged summation of squares of image difference;

whereby, if a jump happens to the head carrier during its moving in the image space for some reason, the locator needs to be put back to the nearest reference point for the new relative displacement;

whereby, if necessary, the process is monitored by coarser positioning method, of wave-based positioning method;

whereby, as a derived conclusion, minimization of image-correlation leads to maximization of convolution of two pictures, for which fast Fourier transfer can be applied.

26. The method of claim 25, wherein, minimization of image-correlation for small size of image comprising:

providing a method for simple motion and speed up motion being used for near linear trace;

providing a method for complex motion being used for other than near linear trace.

* * * * *